US006702687B1

(12) United States Patent
Henry

(10) Patent No.: US 6,702,687 B1
(45) Date of Patent: Mar. 9, 2004

(54) CONTROLLER SYSTEM FOR WATER AMUSEMENT DEVICES

(75) Inventor: Jeffery W. Henry, New Braunfels, TX (US)

(73) Assignee: NBGS International, Inc., New Braunfels, TX (US)

( * ) Notice: Subject to any disclaimer, the term of this patent is extended or adjusted under 35 U.S.C. 154(b) by 0 days.

(21) Appl. No.: 09/891,621

(22) Filed: Jun. 25, 2001

Related U.S. Application Data

(60) Provisional application No. 60/213,962, filed on Jun. 23, 2000.

(51) Int. Cl.[7] ..... A63G 31/00
(52) U.S. Cl. ..... 472/128; 472/117
(58) Field of Search ..... 472/116, 117, 472/128, 136, 137, 59, 60, 61

(56) References Cited

U.S. PATENT DOCUMENTS 2,888,205 A 5/1959 Trucco
4,205,785 A 6/1980 Stanley
4,305,117 A 12/1981 Evans
4,376,404 A 3/1983 Haddad
4,564,190 A 1/1986 Frenzl
4,792,260 A 12/1988 Sauerbier
4,817,312 A 4/1989 Fuller et al.
4,850,896 A 7/1989 Smith et al.
4,905,987 A 3/1990 Frenzi
4,954,014 A 9/1990 Sauerbier et al.
4,960,375 A 10/1990 Saito et al.
5,011,134 A 4/1991 Langford
5,011,161 A * 4/1991 Galphin ..... 273/349
5,020,465 A 6/1991 Langford
5,022,588 A 6/1991 Haase
5,069,387 A 12/1991 Alba
5,073,082 A 12/1991 Radlik
5,143,107 A 9/1992 Kelley
5,152,210 A 10/1992 Chen
5,171,101 A 12/1992 Sauerbier et al.
5,194,048 A 3/1993 Briggs
5,213,547 A 5/1993 Lochtefeld
5,219,315 A * 6/1993 Fuller et al. ..... 348/124
5,224,652 A 7/1993 Kessler
5,230,662 A 7/1993 Langford
5,236,280 A 8/1993 Lochtefeld
5,265,802 A 11/1993 Hobbs et al.
5,271,692 A 12/1993 Lochtefeld
5,393,170 A 2/1995 Lochtefeld
5,401,117 A 3/1995 Lochtefeld
5,421,782 A 6/1995 Lochtefeld
5,433,671 A 7/1995 Davis
5,439,170 A 8/1995 Dach
5,453,054 A 9/1995 Langford
5,494,729 A 2/1996 Henry et al.
5,503,597 A 4/1996 Lochtefeld et al.
5,564,859 A 10/1996 Lochtefeld
5,628,584 A 5/1997 Lochtefeld
5,664,910 A 9/1997 Lochtefeld et al.
5,667,445 A 9/1997 Lochtefeld
5,685,778 A * 11/1997 Sheldon et al. ..... 472/128
5,738,590 A 4/1998 Lochtefeld
5,779,553 A 7/1998 Langford
6,161,771 A 12/2000 Henry
6,186,902 B1 * 2/2001 Briggs ..... 472/117
6,261,186 B1 7/2001 Henry

* cited by examiner

*Primary Examiner*—Kien T. Nguyen
(74) *Attorney, Agent, or Firm*—Meyertons, Hood, Kivlin, Kowert & Goetzel, P.C.; Eric B. Meyertons

(57) ABSTRACT

A programmable logic controller for a water system is described. The controller is configured to operate the water system to produce water effects when the controller receives a participant signal. The controller is further configured to produce water effects in the absence of a participant signal to attract participants to the water system.

92 Claims, 22 Drawing Sheets

CONTROLLER SYSTEM FOR WATER AMUSEMENT DEVICES

PRIORITY CLAIM

This application claims priority to U.S. Provisional Patent Application No. 60/213,962 entitled "Controller System For Water Amusement Devices" filed on Jun. 23, 2000.

BACKGROUND OF THE INVENTION

1. Field of the Invention

The present disclosure generally relates to water amusement attractions and rides. More particularly, the disclosure generally relates to a system and method in which participants are actively involved in a water attraction.

2. Description of the Relevant Art

Water recreation facilities have become a popular form of entertainment in the past few decades. Conventional water attractions at amusement parks typically involve using gravity to make water rides work, or they involve spraying water to create a fountain. The water rides that use gravity typically involve water flowing from a high elevation to a low elevation along a water ride surface. These gravity induced rides are generally costly to construct, and they usually have a relatively short ride time. Conventional fountains in water parks are generally passive attractions for people because guests of the parks usually cannot control the water flow in these fountains.

One water attraction that allows guests to become more actively involved with water spraying objects is described in U.S. Pat. No. 5,194,048 to Briggs. This attraction relates to an endoskeletal or exoskeletal participatory water play structure whereupon participants can manipulate valves to cause controllable changes in water effects that issue from various water forming devices.

A class of water attraction rides which are not gravity induced has been added to the theme park market. U.S. Pat. No. 5,213,547 to Lochtefeld discloses a method and apparatus for controllably injecting a high velocity of water over a water ride surface. A rider that rides into such injected flow can either be accelerated, matched, or de-accelerated in a downhill, horizontal or uphill straight or curvilinear direction by such injected flow. U.S. Pat. No. 5,503,597 to Lochtefeld et al. discloses a method and apparatus for controllably injecting high velocity jets of water towards a buoyant object to direct buoyant object movement irrespective of the motion of water upon which the buoyant object floats. U.S. Pat. Nos. 5,194,048, 5,213,547 and 5,503,597 are incorporated by reference as if fully set forth herein.

SUMMARY OF THE INVENTION

I. Controller System

An interactive controller system for water features is provided. In one embodiment, the controller system may be a programmable logic controller utilizing industrial controls, sensors, and valves coupled to the controller to provide a wide variety of interactive and automated water features. In an embodiment, participants apply a participant signal to activation points. The activation points send signals to the controller in response to the participant signals. The controller may be configured to active a water feature, a light feature, a mechanical feature and/or a sound feature in response to the signal from the activation point. The participant signal may be applied to the activation point by the application of pressure, moving a movable activating device, a gesture (e.g., waving a hand), or by voice activation. Examples of activation points include, but are not limited to, hand wheels, push buttons, pull ropes, paddle wheel spinners, motion detectors, sound detectors, and levers. The controller may also include sensors to detect the presence of a participant proximate to the activation point. The controller may be coupled to valves or electric switches. Valves may includes air valves and water valves configured to control the flow air or water, respectively, through the water feature. Electric switches may be coupled to light or sound producing devices.

The controller may be programmed to receive one or more input signals from one or more activation points, process the signal or signals, and activate one or more devices in response. The controller may also include an interactive input device to enable a client to make adjustments of the controllers response to input signals. The control system may be configured such that a programmable logic controller may provide control over a plurality of water features or individual water features.

Proximity detectors may be coupled to the controller. The proximity detector may be configured to signal the controller when a participant moves within the detection range of the proximity detector. The controller may be programmed to activate a water feature effect or sequence of water feature effects in response to the participant moving within the detection range. Alternatively, the controller may be configured to produce a water feature effect or sequence of water feature effects when no participants are in the detection range of the proximity detector. This "attract" mode/program may entice passersby to approach the features and interact with the controls. When a participant begins to interact with the controls, the controller may revert to control inputs from the participant. By selecting a variety of "on" and "off" time limits for each feature, a play element may become an automated fountain of water/light/sounds effects that come on and off when the element is left without interaction by participants or passersby.

II. Water Fountain System

A water fountain system including a controller as described above may include a rotatable roof that may rotate in response to streams of fluids. The water fountain system may have the operational ability to allow changes to water effects in response to signals received by a controller from activation points.

An embodiment of the water fountain system includes a roof having a friction surface. The roof may have the ability to rotate about a vertical axis when a jet of water hits the friction surface. The friction surface may include a plurality of protrusions (e.g., rib-like members, indentions, or protruding structures) providing a contact surface for receiving the water. The water fountain system preferably includes a support member connected to the roof and to the ground below. A first conduit preferably directs water from a water source to a first nozzle located near the roof. For example, the first nozzle may direct a jet of water in a first direction toward the roof to cause the roof to rotate in a substantially clockwise direction. A second conduit preferably directs water to a second nozzle also located near the roof. The second nozzle may then direct a jet of water in a second direction toward the roof to cause the roof to rotate in a substantially opposite, or a counterclockwise direction.

A diverter valve may be disposed upstream from the first conduit and the second conduit. The diverter valve may direct water to one of the first or second conduits while restricting water flow through the other conduit. The valve may be located near the ground so that it may be adjusted by a participant. In a multi-level system the valve may be located on one or more levels of the system. The valve may also be located near the roof.

A controller may be coupled to valves that control the flow of water to the system or that control the operation of the diverter valve. The controller system may be coupled (e.g., electrically, mechanically, or pneumatically) to the valve. The controller system may be manipulated by one or more participants to operate the valve from the ground, or on any other level. Operation of the valve may also cause activation of any combination of the sound and/or lighting system. After a certain predetermined amount of time with no participant signal received, the controller system may activate into an attract mode. This may consist of operating the water fountain system in a random, arbitrary, or preprogrammed manner. This operation may act to attract attention from onlookers or passersby, who may be enticed to interact with the water fountain system.

III. Water Cannon System

A water cannon system may include a tube from which water may be ejected in response to a control signal. A controller as described above may be coupled to the water cannon to control the operation of the water cannon. A water cannon may include a first hollow member including a closed end and an opposite end having an opening therein; a second hollow member including first and second opposing open ends, wherein the second hollow member is of smaller diameter than the first hollow member, and wherein, during use, the second hollow member is disposed in the opening in the first hollow member to form an airtight seal within the opening, such that the first open end is preferably outside or coplanar with the first hollow member and the second open end is inside the first hollow member; a partition member with an opening therein to accommodate the channel in a slidable engagement therein, wherein, during use, the partition member is disposed inside the first hollow member and the second hollow member is disposed in the opening in the partition member, such that the partition member is slidable along at least a portion of the second hollow member, and further wherein the partition member substantially forms a partition from the exterior surface of the second hollow member to the interior surface of the first hollow member; one or more fluid inlets connected to a fluid source and effective to release fluid into the first hollow member during use; one or more gas inlets connected to a source of pressurized gas, and effective to release a gas into the first hollow member during use, and wherein the partition member is disposed between a gas inlet and the closed end of the first hollow member during use; and the controller in communication with a gas inlet and one or more activation points and one or more sensors.

The act of applying a participant signal to an activation point may cause a projectile of water to be produced from the water cannon. The activation points may be configured to signal the controller system in response to the participant signal. The activation points may be located on instruments. The activation points may sense the participant signal applied by the participant(s) and send a signal to the controller, which may respond by sending a signal to the activate the water cannon system.

The water cannon system may include a sensor in the vicinity of the activation points configured to signal the controller when a participant is near the activation points. The controller may be programmed to activate into an attract mode after a predetermined amount of time with no participant signal and/or no signal from the proximity sensor. This mode may include operating the cannon in a random, arbitrary, or preprogrammed fashion. This operation may serve to entice passersby to approach the activation points and participate with the water cannon system.

IV. Musical Water Fountain System

A musical water fountain system including a controller as described above may include a sound system for playing one or more musical notes, a water system for producing water effects, a light system for displaying lights, and a plurality of activation points for activating the sound system, the water system, and/or the light system.

The act of applying a participant signal to the activation points preferably causes one or more of the following: a sequence of music notes is produced, a water effect is produced, and lights are activated. A participant signal may be applied by the application of pressure, a gesture (e.g., waving a hand in front of a motion sensor), or voice activation. The activation points are configured to respond to the applied participant signal. The activation points may be coupled to the controller, which is configured to sense the participant signal. The activation points preferably respond to the participant signal applied by the participant(s) and send a signal to the controller. The controller processes the signal, and depending on the type of signal, may send a signal to the fountain system, and/or a second signal to the light system, and/or a third signal to the sound system.

The controller may be configured to provide participants with a visual, audio, or tactile indication at a predetermined time to alert the participants to apply a participant signal to a specific activation point. There may be a proximity sensor in the vicinity of the activation point configured to signal the controller when a participant is near the activation point. When the sensor signals the controller, a light, sound, or tactile signal may be activated by the controller to indicate to the participants to apply a participant signal to the activation points.

After a certain predetermined amount of time with no participant signal received, the controller may activate an attract mode. This may consist of operating any combination of the light, sound, and/or water effects in a random, arbitrary, or preprogrammed manner. This operation may act to attract attention from onlookers or passersby, who may be enticed to interact with the musical water fountain system.

Each of the inventions I–IV discussed above may be used individually or combined with any one or more of the other inventions.

BRIEF DESCRIPTION OF THE DRAWINGS

Other objects and advantages of the invention will become apparent upon reading the following detailed description and upon reference to the accompanying drawings in which.

Figure 1:
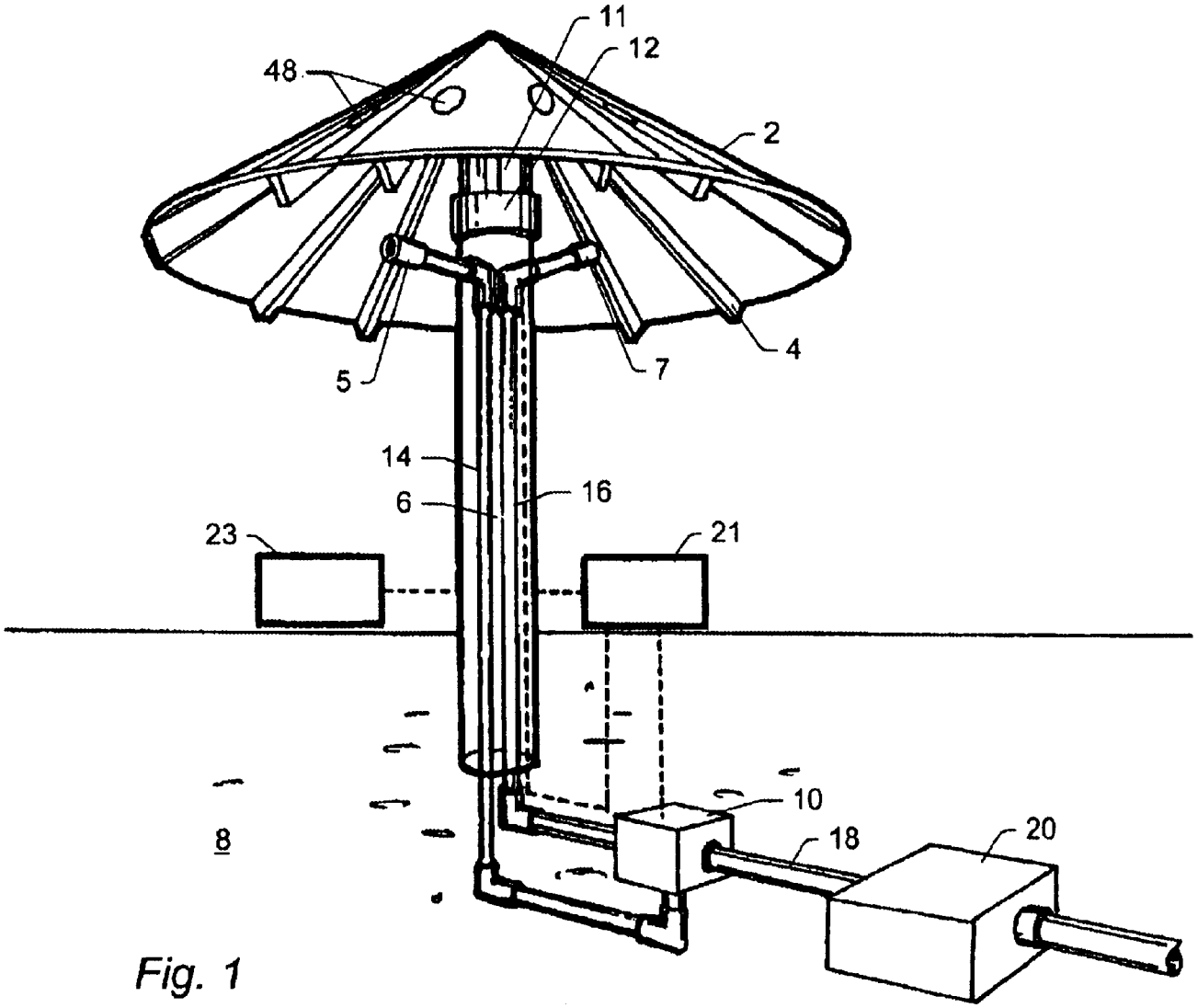
FIG. 1 is a perspective view of one embodiment of a water fountain system having an exoskeletal support member.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

I. Controller System

Figure 25:
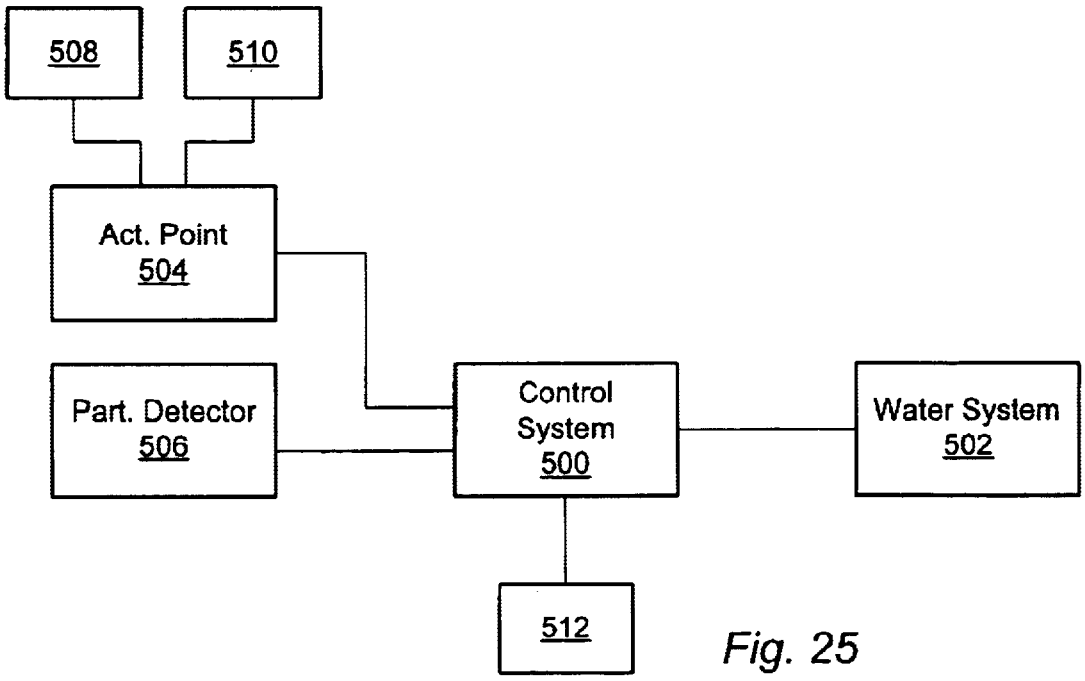
FIG. 25 depicts a schematic of a controller system for a water system.

FIG. 25 is a schematic of one embodiment of a water amusement system. The water amusement system includes a water system 502. Water system 500 is configured to produce one or more water effects. A control system 500 is coupled to the water system. Control system 500 is configured to generate water system control signals and send the water system control signals to water system 502. Water system 502 is configured to generate a water effect in response to receiving a water system control signal. Control system 500 may be configured to generate a plurality of different water system control signals. Water system 502 may be configured to generate different water effects in response to different water system control signals.

The water amusement system may also include an activation point 504 coupled to control system 500. Activation point 504 is configured to receive a participant signal. A participant signal may be applied to the activation point by a participant who desires to activate the water amusement system. In response to the participant signal, activation point 504 may generate one or more activation signals. Activation signals may be sent to control system 500. The activation signals may indicate that a participant has signaled the activation point. In response to the activation signal, the control system may generate one or more water system control signals. Activation point 504 may include a plurality of input devices 508 and 510. Input devices 508 and 510 may be configured to receive the participant signals. Activation point 504 may be configured to generate a plurality of activation signals in response to a plurality of participant signals. The control system may also be configured to generate a plurality of water system control signals in response to the activation signals.

A participant detector 506 may be coupled to control system 500. Participant detector 506 may be configured to generate a detection signal when a participant is within a detection range of the participant detector 506. The detection signal may be sent to control system 500. In response to a received detection signal, control system 500 may generate one or more water system control signals. This "attract" mode may entice participants that are in the proximity of the water amusement system to approach the system and interact with the controls at activation point 504.

In another embodiment, control system 500 may be configured to stop the production of water system control signals in the absence of a signal. When no participants are present at activation point 504, a controller may be configured to cease the production of water system control signals. In this manner the water amusement system may be "turned off" in the absence of participants.

In another embodiment, control system 500 may be configured to produce random, arbitrary or predetermined water system control signals in the absence of a signal. Thus, when no participants are present at activation point 504, a controller may revert to an attract mode, producing water system control signals to activate the water system such that participants are attracted to the water amusement system. Control system 500may be configured to generate water system control signals in the absence of an activation signal or a detection signal after a predetermined amount of time. When a participant begins to interact with activation point 504, control system 500 may resume generating water system control signals in response to the participants input.

The participant signal may be applied by the application of pressure, moving a movable activating device, a gesture (e.g., waving a hand), or by voice activation. The activation point may be configured to respond to the participant signal. In one embodiment, the activation point may be configured to respond to a participant's touching of the activation point.

The activation point may respond to varying amounts of pressure, from a very light touch to a strong application of pressure. Alternatively, the activation point may include a button which is depressed by the participant to signal the activation point. In another embodiment, the activation point may include a movable activation device. For example, the activation point may be a lever or a rotatable wheel. The participant may then signal the activation point by moving the lever (e.g., reciprocating the lever) or rotating the wheel. In another embodiment, the activation point may respond to a gesture. For example, the activation point may be a motion detector. The participant may then signal the activation point by creating movement within a detection area of the motion detector. The movement may be created by passing an object (e.g., an elongated member) or a body part (e.g., waving a hand) in front of the motion detector. In another embodiment, the activation point may be sound activated. The participant may signal the sound activated activation point by creating a sound. For example, by speaking, shouting or singing into a sound sensitive activation point (e.g., a microphone) the activation point may become activated.

In another embodiment, activation point 504 may include a hand wheel. A hand wheel may be a rotary activated input device. In one embodiment, the hand wheel includes at least one sensor to determine the direction and number of times the hand wheel is rotated. In one embodiment, the hand wheel may produce a signal to turn "on" a water feature or turn "off" a water feature based on the number of turns of the wheel detected by the sensor. The signal to turn "on" and "off" may be sent based on a predetermined number of turns of the wheel. The signal to turn "on" or "off" may be produced by the same number of turns for each signal, or by a different number of turns. In another embodiment, the signal to turn "on" or "off" may be determined by the direction of rotation. The use of multiple sensors coupled to a hand wheel may allow the direction of rotation of the hand wheel to be determined. For example, a clockwise rotation of the wheel may produce an "on" signal, while a counterclockwise rotation of the wheel may produce an "off" signal. In another embodiment, the programmable controller may be configured to turn "on" successive water features with each turn of the wheel (e.g., in a clockwise direction), and turn "off" the successive water features in a reverse sequence with each turn of the wheel in the opposite direction (e.g., in a counterclockwise direction. Alternatively, the wheel may produce a signal to turn "on" water features in a random or arbitrary manner with each turn of the wheel (e.g., in a clockwise direction), and turn "off" the water features in a random or arbitrary sequence with each turn of the wheel in the opposite direction (e.g., in a counterclockwise direction).

The water system may water control devices that are coupled to a water effect generator. The water control devices may allow control over the operation of the water effect. Water control devices include valves such as a solenoid actuated valve. The valve may be an air valve or a water valve. Water valves allow the flow of water to a water effect generator to be altered during use. Air valves allow the flow of air to a water effect generator to be altered. Generally, the valve may be capable of receiving a water system control signal from control system 500 and performing some action in response to the water system control signal.

In one embodiment, the water valve may be opened, releasing a stream of water or closed, cutting off a stream of water depending on the type of water system control signal received from the control system. The water valve may also be configured to vary the volume of the water stream in response to a water system control signal from the control system. In one embodiment, the water valve may be a diaphragm valve that is operated by a solenoid. Such valves may be used to control the flow of water or air through a water system. The size of the valve may vary depending on the type of feature desired. For example, valve sizes may vary from about ½ in. to about 2 in. depending on the type of feature.

A variety of water features may be controlled by a water valve coupled to the programmable logic controller. Nozzles may be used to create a spray pattern. Spray patterns include, but are not limited to, fan sprays, cone sprays, streams, or spirals. The water valve may also be coupled to a system for producing a waterfall effect. The valve may be used to control the flow of water to the waterfall. The water valve may be part of a rain curtain effect. A rain curtain effect may include a number of nozzles used to create streams of falling droplets that appear as a "curtain" of water. Combinations of valves activated in sequence may be used to produce an "explosion" of water. Air geysers or cannons use valves to control both air and water flow to produce a "pulse" of water. The valves may be activated in sequence to control the flow of water and air to the geyser or cannon. An actuator may therefore control two or more valves in response to a single signal to generate a pulse of water. Spinning roof water features, described in more detail below, may also include multiple valves controlled by one or more actuators. The direction of rotation of the spinning roof feature may be controlled by which of the valves are opened. Paddlewheel water features may also operate in a similar manner. In both cases one or more actuators may be used to control the water valves. The water feature may also include a rotatable container of water. The container may be at least partially filled with water. At a predetermined time or level of water, the container may be tilted such that some or all of the water in the container is poured out. One or more actuators may be coupled to pneumatic or hydraulic cylinders and water valves for filling and rotating the container. Water cannons, as described herein, are also an example of a water effect that may be produced by a water system.

Participant detector 506 may be a photoelectric eye, an inductive proximity sensor, a flow sensor, a water level sensor, or any of many other sensors well known to one skilled in the art. In general, participant detector 506 is any device capable of detecting a change in the surroundings and sending a signal to control system 500 in response. In an embodiment, the participant detector 506 is a photoelectric eye, and it sends a signal to control system 500 in response to an object intersecting its projected beam. Participant detector 506 may produce a signal when a participant passes into the detection range of participant detector 506. The control system 500 may, in response to the produced signal, produce a variety of water effect to attract the attention of the participant to the water system.

A control system input device 512may be coupled to control system 500. Control system input device 512 may be a keyboard, an electronic display screen, a touch pad, a touch screen, any combination of these devices, or any other input device known to one skilled in the art. Generally, control system input device 512 is any device capable of transmitting and receiving signals to and from control system 500. In one embodiment, the control system input device 512 is a touch screen capable of displaying information and receiving input in the form of contact with the screen. The screen may display a series of menus with different programming options for control system 500, with the client choosing the desired option, touching the appropriate area of the screen, and having the screen transmit the signal to the control system 500. In this manner, the actions of control system 500 may be altered by the owner of the water amusement system. Control system 500 is a processing unit capable of receiving one or more input signals, processing the signals, and sending one or more output signals in response. It is also capable of being programmed, that is, configured by the user to perform a variety of tasks. Control system 500 may be configured to signal an actuator on or off; for example, control system 500 may signal a water valve to open at the push of a button and signal the water valve to close when the button is released. Control system 500 may also be configured to signal an actuator on or off in response to a signal from a sensor. Control system 500 may also be programmed to turn actuators on and/or off after a certain period of time determined by the client or some default period. For example, control system 500 may be programmed to open and close a fountain valve every 60 seconds. Control system 500 may also be programmed to turn actuators on or off after a certain period of time with no input from any control or sensor, or to initiate a sequence of different actions by one or more actuators after a predetermined period of time. For example, if the controls have not been signaled for 5 minutes, control system 500 may be programmed to open one or more water valves and turn on one or more lights to display the capabilities of the devices. This feature may serve to attract participants to interact with the devices. Many other actions and combinations of actions may be programmed into control system 500, which are well known to one skilled in the art. Control system 500 may also be configured to turn the water features off if left on for a predetermined amount of time. In one embodiment, a variety of "on" and "off" time limits may be programmed into control system 500 such that the water system may become an automated water feature that operates in the absence of a participant signal.

Control system 500 may be a programmable logic controller (PLC). PLCs may be used to monitor input signals from a variety of input points which report events and conditions occurring in a process. In response to these input signals provided by input sensors, the PLC derives and generates output signals which may be transmitted via PLC output points to various output devices, such as actuators and relays, to control the water effect devices. PLCs may control a plurality of actuators, such as, but not limited to 8, 16 or 32 actuators. Additionally, a single PLC may be configured to control a plurality of water devices.

PLCs may be configured in a plurality of ways with regard to voltage input and output, memory availability and programmability. A PLC may be configured to utilize input power of 120 VAC and the actuators may be configured to utilize input power of 12 or 24 VDC. However, these power values should not be considered limiting and multiples or fractions of these values may be used. PLCs may be combined in multiples in an Input/Output (I/O) chassis such that the PLC may communicate with the supervisory processor or other PLCs while communicating with its own local I/O devices. The PLC memory may be expanded with additional memory modules. The PLCs may be remotely programmed and/or controlled from a central computer system. PLCs with the aforementioned capabilities may be obtained commercially from a plurality of vendors. Further information on PLCs may be found in U.S. Pat. No. 5,978,593 to Sexton, which is incorporated herein by reference.

Figure 26:
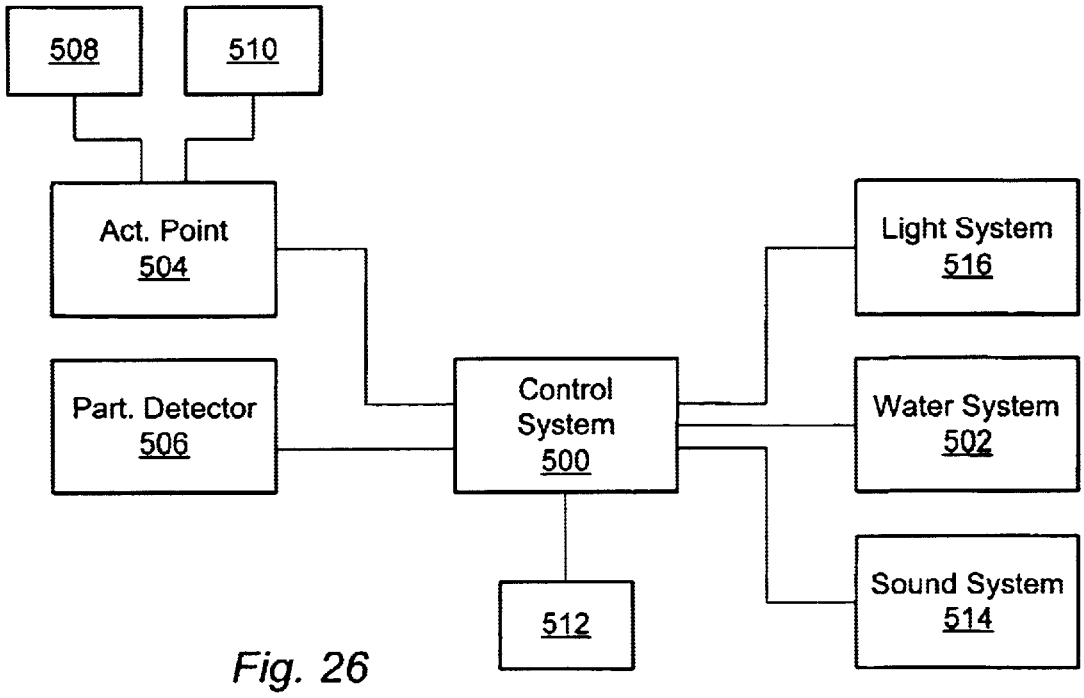
FIG. 26 depicts a schematic of a controller system for a water system, a sound system and a light system.

FIG. 26 is a schematic of one embodiment of a water amusement system. The water amusement system includes a water system 502 and a sound system 514. Water system 500 is configured to produce one or more water effects. Sound system 514 is configured to produce one or more sound effects. Examples of sound effects are described below in more detail. In some embodiments, sound system 514 and water system 502 may be integrated together such that the sounds appear to be emanating from the water effects during use. A control system 500 is coupled to water system 502 and sound system 514. Control system 500 is configured to generate water system control signals and send the water system control signals to water system 502. Control system 500 is configured to generate sound system control signals and send the sound system control signals to sound system 502. Water system 502 is configured to generate a water effect in response to receiving a water system control signal. Sound system 514 is configured to generate a sound effect in response to receiving a sound system control signal. Control system 500 may be configured to generate a plurality of different water system control signals and sound system control signals. Water system 502 may be configured to generate different water effects in response to different water system control signals. Sound system 514 may be configured to generate different sound effects in response to different sound system control signals.

The water amusement system may also include an activation point 504 coupled to control system 500. Activation point 504 is configured to receive a participant signal. A participant signal may be applied to the activation point by a participant who desires to activate the water amusement system. In response to the participant signal, activation point 504 may generate one or more activation signals. Activation signals may be sent to control system 500. The activation signals may indicate that a participant has signaled the activation point. In response to the activation signal, the control system may generate one or more water system control signals. Activation point 504 may include a plurality of input devices 508 and 510. Input devices 508 and 510 may be configured to receive the participant signals. Activation point 504 may be configured to generate a plurality of activation signals in response to a plurality of participant signals. The control system may also be configured to generate a plurality of water system control signals and/or sound system control signals in response to the activation signals.

A participant detector 506 may be coupled to control system 500. Participant detector 506 may be configured to generate a detection signal when a participant is within a detection range of the participant detector 506. The detection signal may be sent to control system 500. In response to a received detection signal, control system 500 may generate one or more water system control signals and/or sound system control signals. This "attract" mode may entice participants that are in the proximity of the water amusement system to approach the system and interact with the controls at activation point 504.

In another embodiment, control system 500 may be configured to stop the production of water system control signals and/or sound system control signals in the absence of a signal. When no participants are present at activation point 504, a controller may be configured to cease the production of water system control signals and/or sound system control signals. In this manner the water amusement system may be "turned off" in the absence of participants.

In another embodiment, control system 500 may be configured to produce random, arbitrary or predetermined water system control signals and/or sound system control signals in the absence of a signal. Thus, when no participants are present at activation point 504, a controller may revert to an attract mode, producing water system control signals to activate the water system and/or sound system control signals to activate the sound system such that participants are attracted to the water amusement system. Control system 500may be configured to generate water system control signals and/or sound system control signals in the absence of an activation signal or a detection signal after a predetermined amount of time. When a participant begins to interact with activation point 504, control system 500 may resume generating water system control signals and sound system control signals in response to the participants input.

In some embodiments, in addition to a water amusement device may also include a light system 516 as depicted in FIG. 26. The light system may be configured to produce light effects. Examples of light effects are described in more detail below. Control system 500 may be coupled to light system 516. Control system 500 may be configured to generate light system control signals, in addition to water system control signals and sound system control signals, to activate the light system. Control system 500 may activate light system 516 in a manner similar to the operation of the water system and the sound system as described above.

II. Water Fountain System

Turning to FIG. 1, one embodiment of a water fountain system for participatory play is illustrated. The water fountain system preferably includes a roof 2 which may have protruding members or protrusions 4 attached to its lower surface. A bearing 12 preferably allows roof 2 to rotate about a substantially vertical axis. Bearing 12 can instead be a bushing. Roof 2 preferably includes a lip 11 which may be a cylindrically shaped shell. Lip 11 preferably extends vertically from the bottom of roof 2. Lip 11 is preferably seated within bearing 12 and may rotate in a substantially clockwise direction or a substantially counterclockwise direction. The rotation of lip 11 is facilitated because there is preferably little or no friction between the outer surface of lip 11 and the inner portion of bearing 12. In an alternative embodiment, lip 11 includes a bearing on its inner surface that substantially surrounds the upper end of support member 6.

An elongated support member 6 preferably supports roof 2, and support member 6 preferably extends from reservoir 8 to roof bearing 12. Reservoir 8 preferably holds water used in the water fountain system. As depicted in FIG. 1, support member 6 may be an "exoskeletal" support member whereby a first conduit 14 and a second conduit 16 are mounted to support member 6 for conveying water to roof 2. Conduits 14 and 16 may be mounted on an inner surface of support member 6 (as depicted in FIG. 1) or on an outer surface of the support member. A first nozzle 5 is preferably coupled to first conduit 14, and a second nozzle 7 is preferably coupled to second conduit 16. First nozzle 5 may direct a jet of water to the lower surface of roof 2 such that roof 2 rotates about support member 6 in a clockwise direction (as viewed from above roof 2). Second nozzle 7 may direct a jet of water to another portion of the lower surface of roof 2 such that roof 2 rotates in a counterclockwise direction (as viewed from above roof 2).

As described herein, a "protrusion" is taken to mean any feature located on the roof that is configured to increase friction between the roof and water that is directed toward the roof. Protrusions 4 may cause the surface of roof 2 to be uneven. Protrusions 4 may be protruding structures or indented portions of roof 2 that facilitate rotation of the roof by providing a contact surface for water directed at the roof. Protrusions 4 are preferably rib-like support members. As described herein, a "friction surface" is taken to mean any surface that is configured to provide substantial resistance to a stream of water. Preferably an upper and/or lower surface of roof 2 is composed of a friction surface such that the roof may be contacted by water to cause rotation of the roof. The friction surface preferably includes protrusions 4.

A third conduit 18 is preferably coupled to first conduit 14 and second conduit 16 to supply water to the first and second conduits. Valve 10 is preferably located at a junction where the third conduit is coupled to the first and second conduits. Valve 10 is preferably a diverter valve which controls water flow to either first conduit 14 or second conduit 16. Valve 10 may be located at any point on or before nozzles 5 and/or 7. Third conduit 18 preferably extends into reservoir 8 to a location below the water level in the reservoir. Pump 20 is preferably disposed within third conduit 18 to force water from the reservoir through the conduits. If valve 10 is adjusted to direct water from third conduit 18 to first conduit 14, water is preferably pumped to nozzle 5. Nozzle 5 then preferably directs a jet of water in a first direction at the bottom of roof 2, which causes the roof to rotate in a clockwise direction. If instead valve 10 is adjusted to direct water to second conduit 16, nozzle 7 preferably directs a jet of water in a second direction to the bottom of roof 2. This jet of water preferably causes roof 2 to rotate in a counterclockwise direction. When water hits roof 2, it is preferably directed off in droplets to create a visual fountain effect. The water preferably passes from the roof back into reservoir 8 so that it may be recycled through the water fountain system.

In any of the embodiments described herein, "nozzle 5" and "nozzle 7" may each include multiple (i.e., one or more) nozzles.

Roof 2 is preferably composed of fiberglass, but it may also be made out of metal, plastic, or any other suitable material. Roof 2 may be substantially flat or it may be non-planar. Roof 2 may have a shape that resembles a figure such as, for example, a square, a circle, a triangle, a cone, a sphere, an umbrella, a pyramid, an animal, an insect, a plant, a dinosaur, a space ship, an inner tube, a boat, an auto, an airplane, etc. First conduit 14, second conduit 16, and third conduit 18 may be made of, for example, PVC, polyethylene, or galvanized steel pipes.

Figure 2:
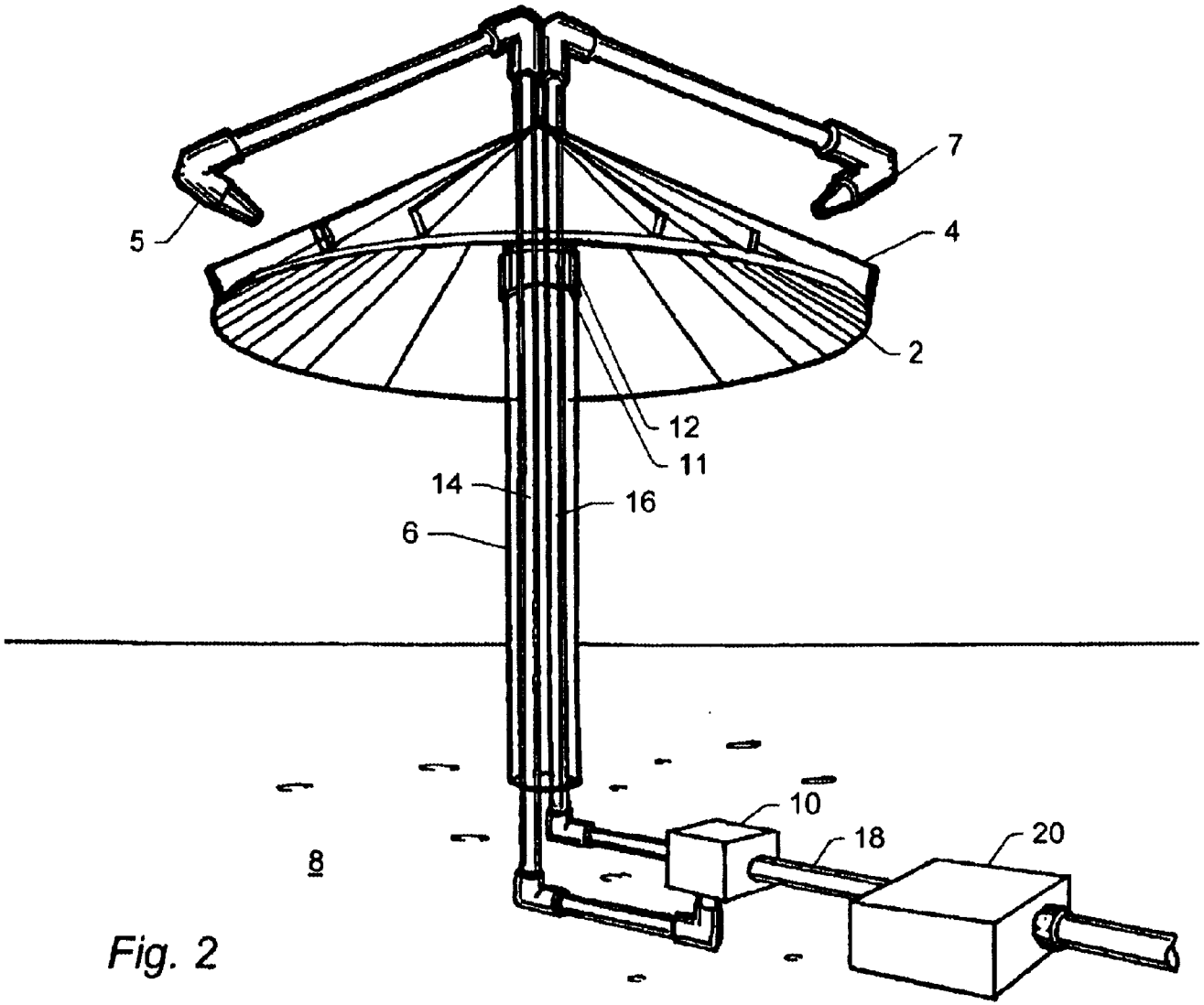
FIG. 2 is a perspective view of one embodiment of a water fountain system having an exoskeletal support member.

Turning to FIG. 2, another embodiment is presented that is similar to the embodiment of FIG. 1. The water fountain system preferably includes the same components as the water fountain system mentioned above. However, first conduit 14 and second conduit 16 preferably extend upwardly through an opening in roof 2 so that the nozzles are positioned above roof 2. The opening in roof 2 is preferably located substantially in the center of lip 11. First nozzle 5 may then direct water in a first direction at the upper surface of roof 2 to cause roof 2 to rotate in a clockwise direction. Roof 2 may have protrusions 4 located on its upper surface to create a friction surface for receiving water. Second nozzle 7 may direct water at the upper surface of roof 2 in a second direction to cause roof 2 to rotate in a counterclockwise direction. First and second nozzles 5 and 7 may be located at any point of the conduits 14 and 16 (e.g., near the center of roof 2, near the edge of roof 2, or any point between).

Figure 3:
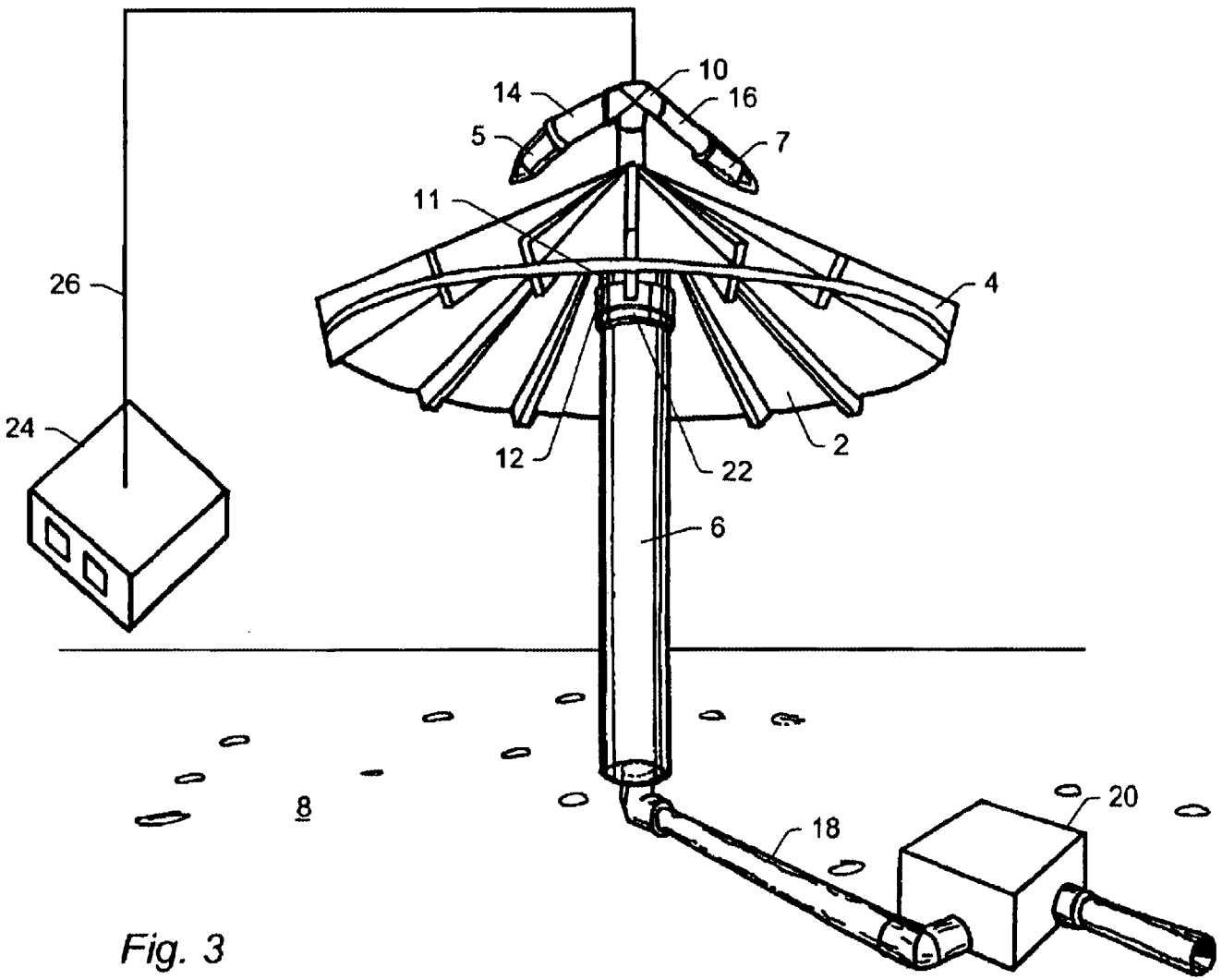
FIG. 3 is a perspective view of one embodiment of a water fountain system having an endoskeletal support member.

FIG. 3 depicts an embodiment of a water fountain system in which support member 6 is an "endoskeletal" support member. An "endoskeletal" support member is one which serves as both a support member and a conduit for passing water to roof 2. In FIG. 3, support member 6 coincides with a portion of third conduit 18. Third conduit 18 preferably extends upwardly through an opening in the roof located inside of lip 11. A ring 22 is preferably attached about third conduit 18 underneath bearing 12 to mount bearing 12 to third conduit 18. Valve 10, first conduit 14, second conduit 16, first nozzle 5, and second nozzle 7 are preferably located above roof 2. Protrusions 4 may be located on the upper surface of roof 2 to form a friction surface at which water may be directed to cause roof 2 to spin. Components of this embodiment preferably perform the same functions as previously discussed. However, valve 10 is preferably controlled from the ground using a controller system 24. The controller system 24 may be operated electrically, mechanically, hydraulically, or pneumatically. Signal lines 26 that preferably include electrical signals, liquid signals, or air, may connect valve 10 to controller system 24. Such signal lines 26 may pass through or outside of support member 6. Controller system 24 may be controlled by simply depressing buttons to cause water to flow through either first conduit 14 or second conduit 16.

Figure 4:
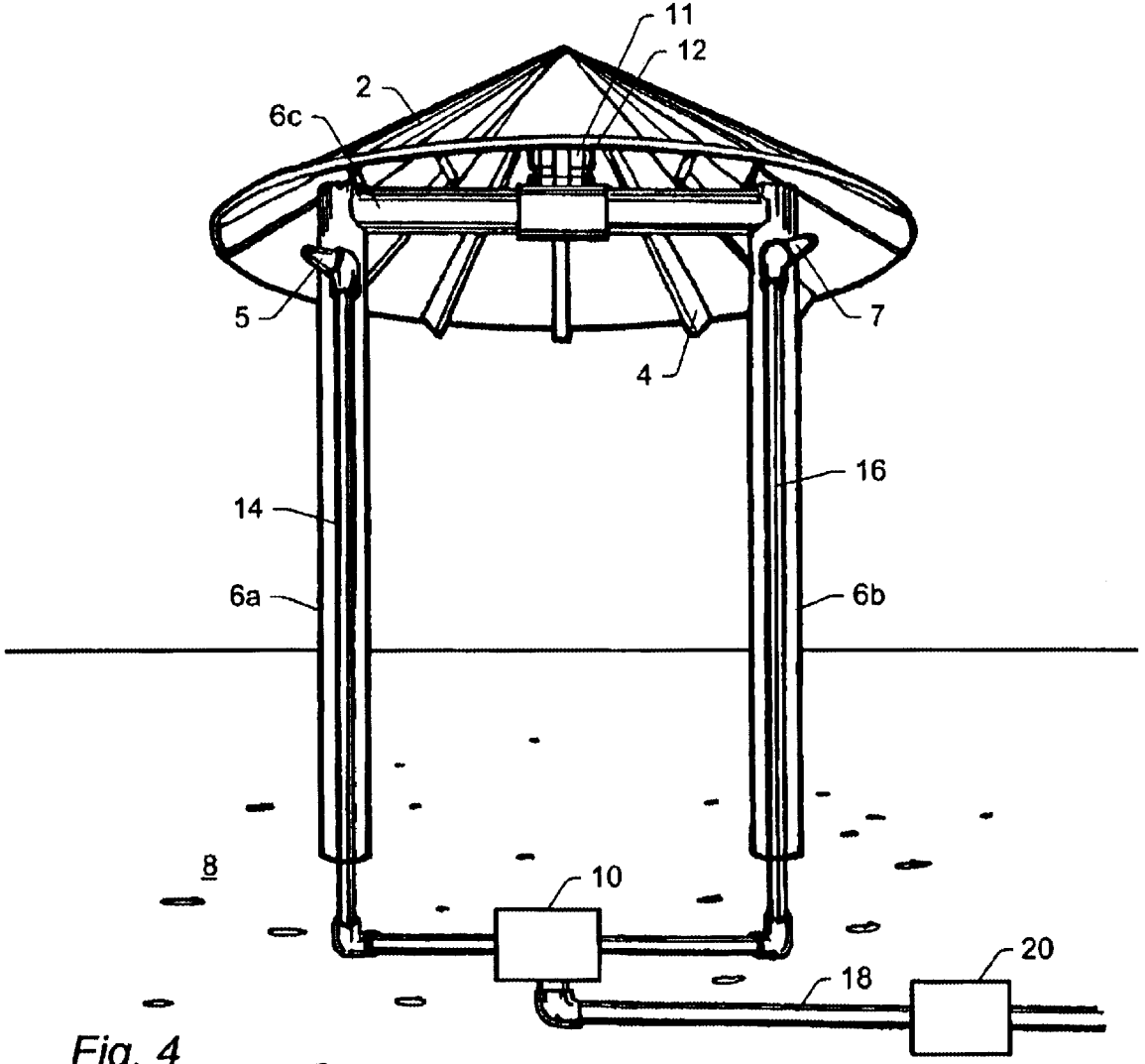
FIG. 4 is a perspective view of one embodiment of a water fountain system having an exoskeletal support member.

FIG. 4 illustrates another embodiment of a water fountain system in which support member 6 is an exoskeletal support member. All of the components of this embodiment preferably have the same functions as previously discussed. Support member 6 preferably has three members. First member 6*a* and second member 6*b* are preferably substantially parallel to one another. They are preferably connected to reservoir 8 at their bottom ends. They preferably extend upwardly to an elevational level below roof 2. Third member 6*c* preferably connects the upper end of first member 6*a* to the upper end of second member 6*b*. Third member 6*c* is preferably substantially perpendicular to members 6*a* and 6*b*. Third member 6*c* is preferably connected to bearing 12. First conduit 14 is preferably mounted to first member 6*a*, and first nozzle 5 is preferably connected to first conduit 14 near the upper end of first member 6*a*. Second conduit 16 is preferably mounted to second member 6*b*, and second nozzle 7 is preferably connected to second conduit 16 near the upper end of second member 6*b*. Roof 2 may have protrusions 4 located on its lower surface to form a friction surface thereon. Third conduit 18 preferably extends from within the water of reservoir 8 to valve 10.

Figure 5:
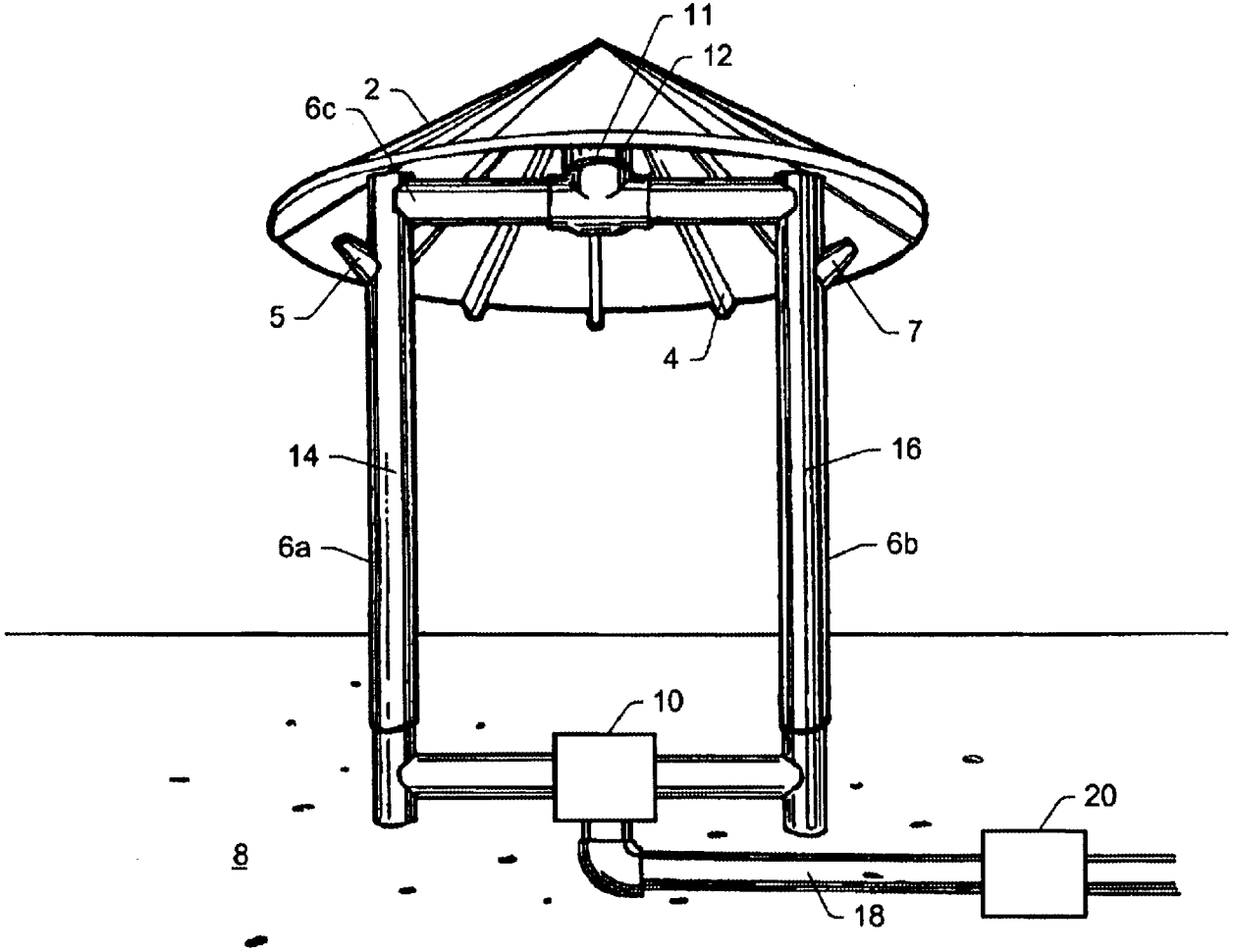
FIG. 5 is a perspective view of one embodiment of a water fountain system having an endoskeletal support member.

FIG. 5 depicts another embodiment of a water fountain system in which support member 6 is an endoskeletal support member. Support member 6 preferably has three members arranged as in FIG. 4 and discussed above. First member 6*a*, however, preferably forms a portion of first conduit 14. That is, water may pass through a section of first member 6*a*. First conduit 14 preferably extends from first member 6*a* toward the roof so that first nozzle 5 may direct water to the lower surface of roof 2. Furthermore, second member 6*b* preferably forms a portion of second conduit 16. Second conduit 16 may extend toward roof 2 from second member 6*b* so that second nozzle 7 can direct water toward the lower surface of the roof. Protrusions 4 may be located on the bottom of roof 2 to form a friction service for receiving water to cause roof 2 to rotate.

Figure 6:
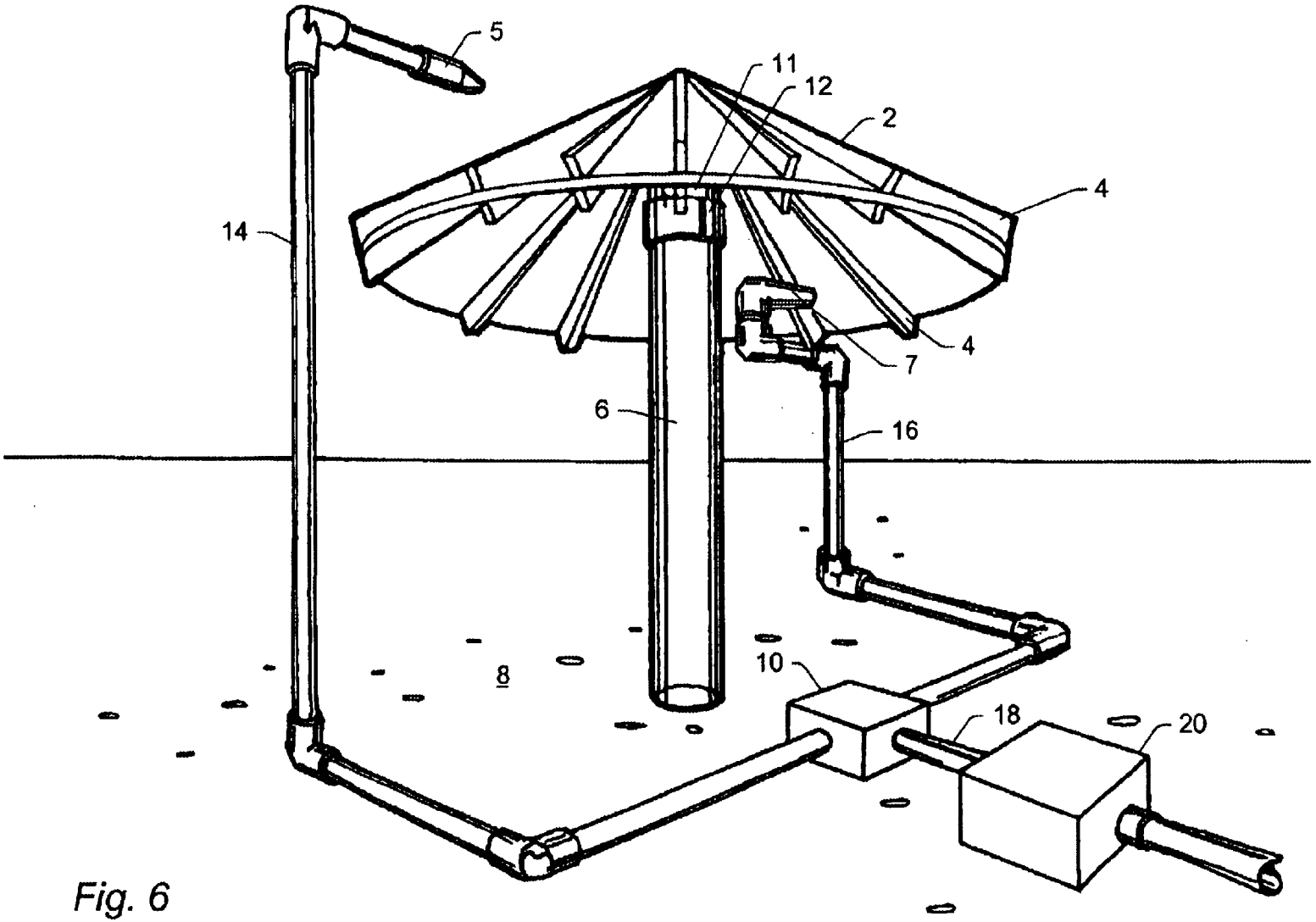
FIG. 6 is a perspective view of one embodiment of a water fountain system having an exoskeletal support member.

FIG. 6 depicts an embodiment of a water fountain system in which support member 6 is an exoskeletal support member. The components of the water fountain system preferably have the same functions as discussed previously. Conduits 14 and 16 may be separated from support member 6. Protrusions 4 may be located on both the upper surface and the lower surface of roof 2 to form a friction surface on both the top and the bottom of roof 2. Conduits 14 and 16 preferably extend upwardly on opposite sides of support member 6 to carry water to the roof. Conduit 14 may extend to an elevational level above roof 2 so that nozzle 5 may direct water at the top of roof 2. Conduit 16 may extend to an elevational level underneath roof 2 so that nozzle 7 may direct water at the bottom of roof 2. Nozzles 5 and 7 may be positioned to simultaneously direct water at the roof to rotate the roof in one direction. In an alternative embodiment, nozzles 5 and 7 direct water toward the roof at different times, whereby nozzle 5 is positioned to cause the roof to rotate in either a clockwise or counterclockwise direction, and nozzle 7 is positioned to cause the roof to rotate in a direction opposite to the rotational direction of the roof when nozzle 5 is used. In an embodiment, the support member 6 may be shaped to resemble a figure such as, for example, a square, a circle, a triangle, a cone, a sphere, an umbrella, a pyramid, an animal, an insect, a plant, a dinosaur, a space ship, an inner tube, a boat, an auto, and or airplane. A sound system may be adapted to play sound effects that relate to the figures represented by the roof 2 and/or support member 6. For example, the support member 6 may have the shape of a dinosaur, and the sound system may be capable of producing sounds that would be associated with a dinosaur. Likewise, the roof may have the shape of, for example, a boat, car, or airplane, and the sound system may be capable of producing sounds generated by boats, cars or airplanes.

Figure 7:
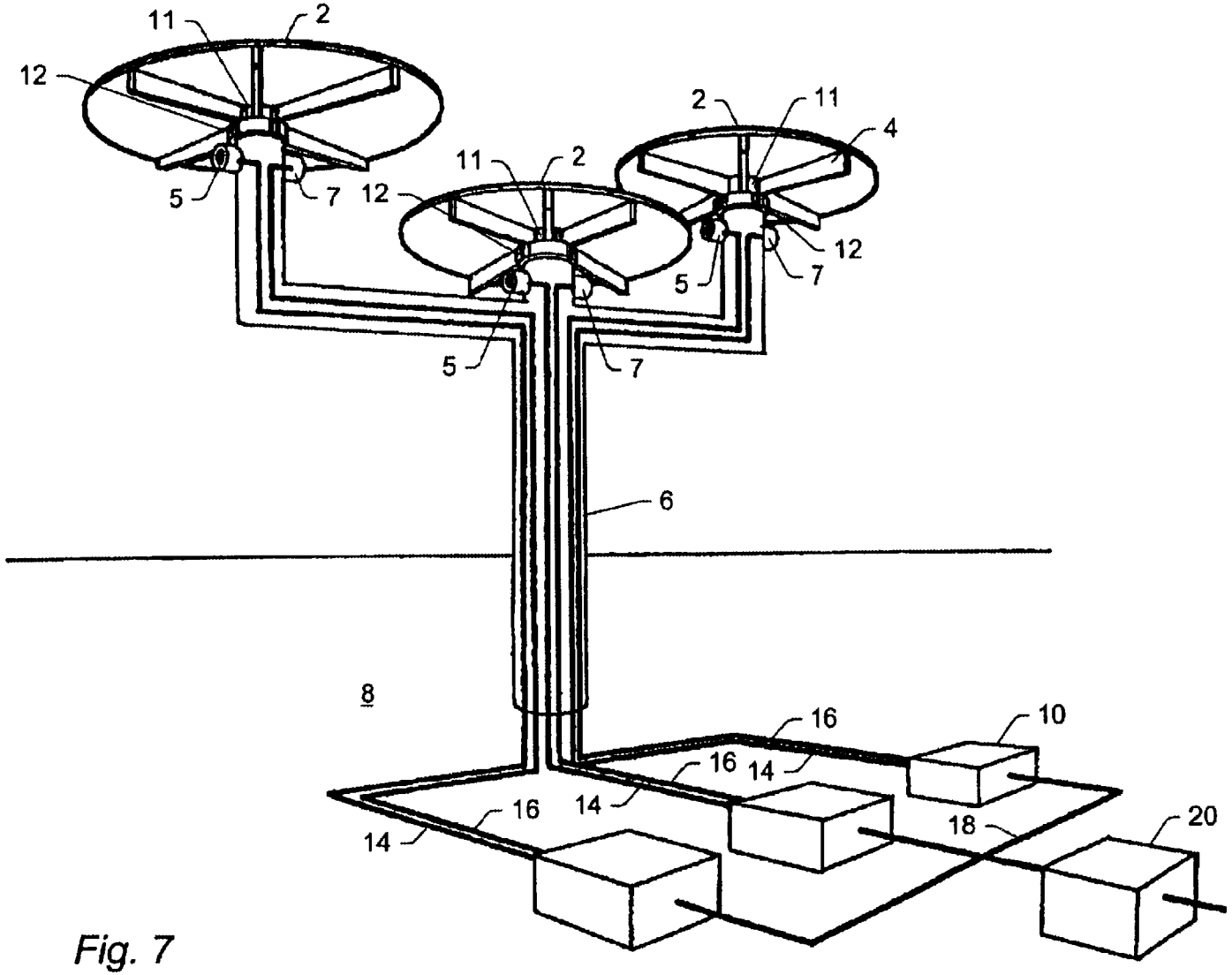
FIG. 7 is a cross-sectional plan view of one embodiment of a water fountain system having a plurality of roofs.

FIG. 7 depicts an embodiment of a water fountain system having a plurality of rotatable roofs 2. Roofs 2 may have any of many different shapes. However, when they are spaced very close together (e.g., stacked on top of one another), roofs 2 preferably have a substantially flat shape to prevent them from contacting each other upon rotating. They may also have protrusions 4 on their upper and/or lower surfaces to form friction surfaces thereon. The water fountain system preferably includes a plurality of conduits 14 and 16, a plurality of nozzles 5 and 7, and a plurality of valves 10. A pump 20 preferably pumps water from reservoir 8 to three valves 10 via conduits 18. Each valve 10 is preferably adjusted to either direct water through conduit 14 or conduit 16. Water is preferably directed to each roof 2 via either nozzles 5 or nozzles 7. Each nozzle 5 may direct a jet of water to its respective roof 2 such that roof 2 rotates in a clockwise direction. Each nozzle 7 may direct a jet of water to its respective roof 2 such that roof 2 rotates in a counterclockwise direction. Bearings 12 and lips 11 of roofs 2 preferably enable roofs 2 to spin.

Figure 8:
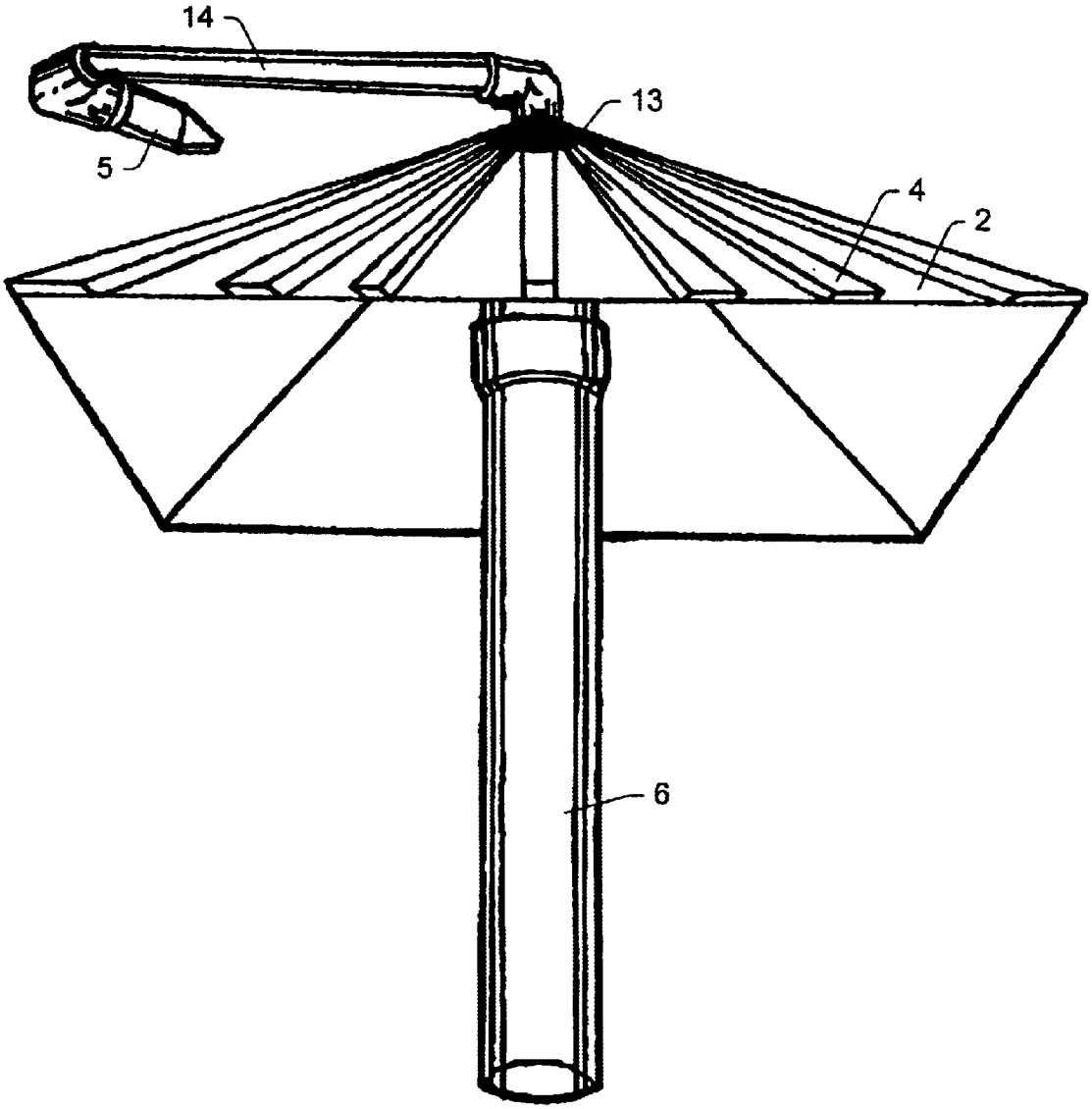
FIG. 8 depicts a perspective view of an embodiment of a water fountain system that includes a roof having members protruding from its surface.
Figure 9:
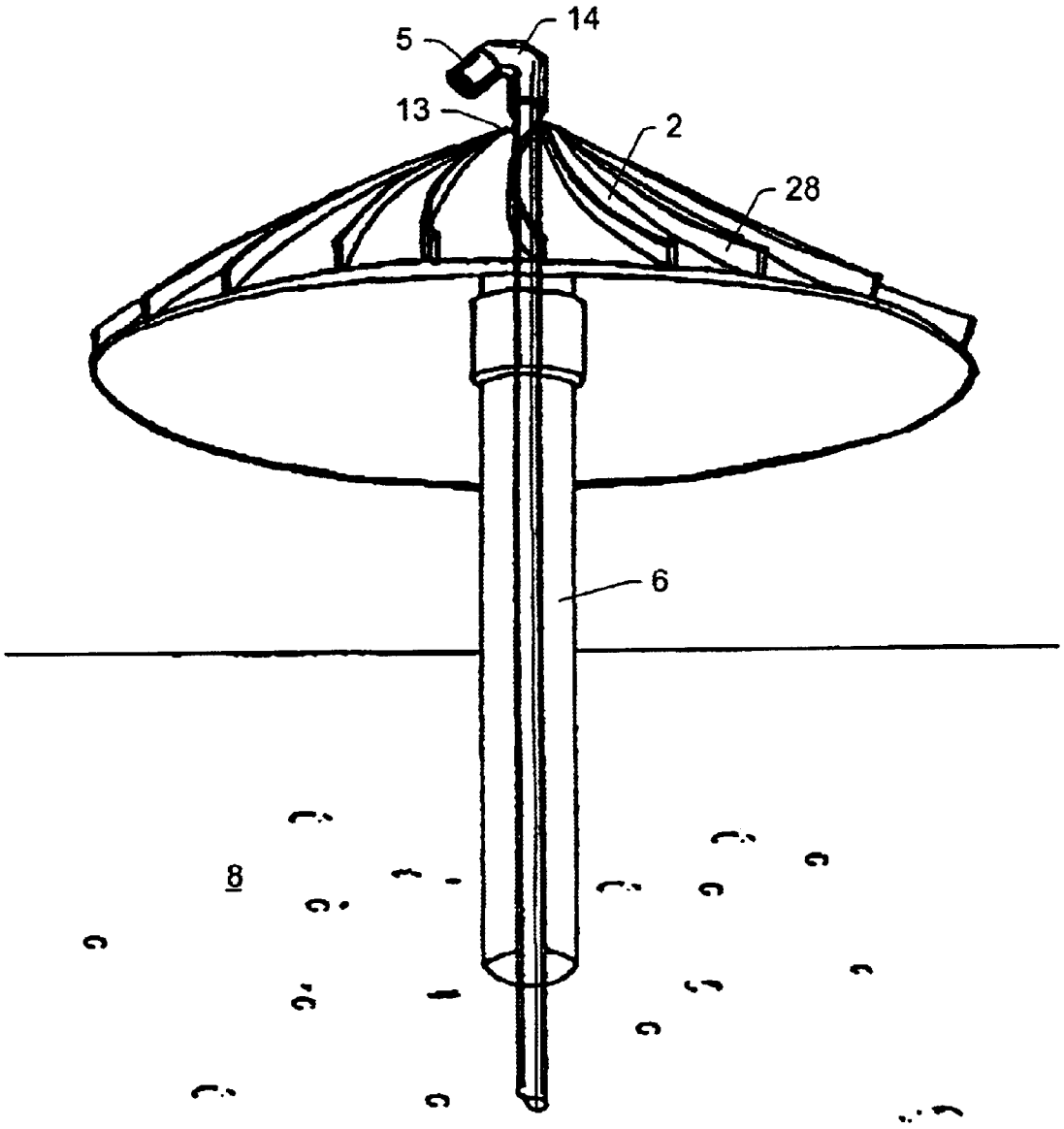
FIG. 9 depicts a perspective view of an embodiment of a water fountain system that includes a roof having curved members protruding from its surface.
Figure 10:
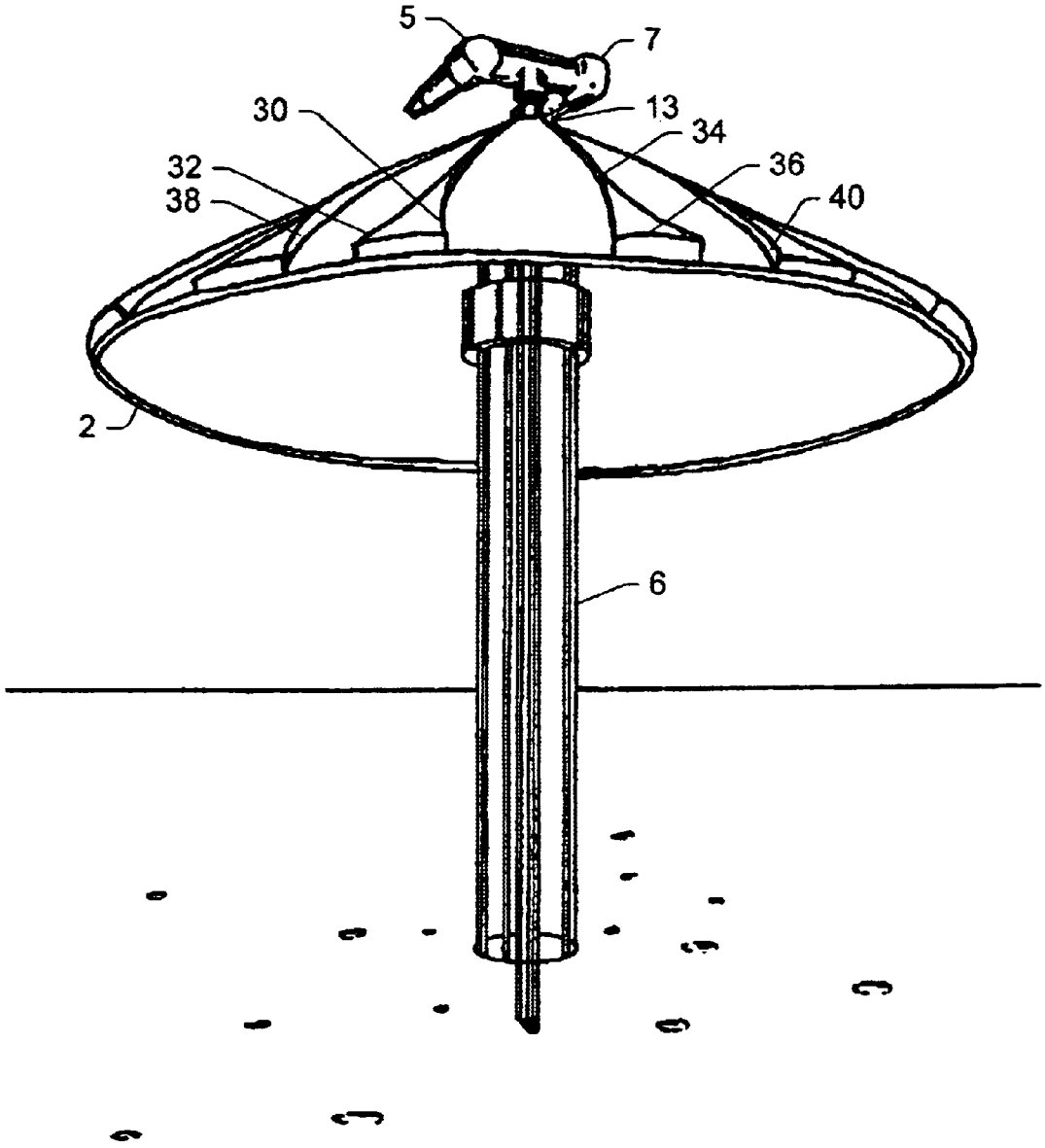
FIG. 10 depicts a perspective view of an embodiment of a water fountain system that includes a roof having curved members protruding from its surface.

The perspective views of various embodiments of roof 2 are depicted in FIGS. 8–10. The protrusions 4 may be ribs that radially extend from central portion 13 of roof 2. The ribs preferably include a contact surface that is raised from the surface of the roof. It is to be understood that protrusions 4 may be disposed on both the top surface and the bottom surface of roof 2, depending upon the position of the nozzles.

Referring to FIG. 8, conduit 14 may extend from central portion 13 toward the outer edge of roof 2 to allow water to be directed from nozzle 5 to the radially outward portions of protrusions 4 to substantially maximize the torque applied to the roof. The water preferably impinges upon the contact surface of the protrusions 4 at a substantially perpendicular angle.

Referring to FIG. 9, the roof may include a plurality of substantially curved ribs 28 radially disposed about the roof. The curved ribs are preferably curved in a direction opposite of the rotational direction of the roof. In this manner, nozzle 5 may direct water toward ribs 28 from a location in the vicinity of central portion 13. The water preferably contacts at least a portion of ribs 28 at a substantially perpendicular angle to cause the roof to rotate.

Referring to FIG. 10, each radially disposed rib may include a pair of complementary curved portions 30 and 32 that extend toward the edge of the roof in diverging directions. The curved portions 30 and 32 are preferably located about the outer edge of the roof. Portion 30 is preferably curved in a direction to allow the roof to rotate in a clockwise direction upon being contacted with a jet of water directed from nozzle 5. Portion 32 is preferably curved in a direction to allow the roof to rotate in a counterclockwise direction upon being contacted with a jet of water directed from nozzle 7.

As shown in FIG. 10, nozzle 5 may be offset from the center of central portion 13 and angled to direct water substantially along flow path 38 of curved portion 30 to rotate the roof in a clockwise direction (as viewed from above). Water flowing along flow path 38 of curved portion 30 is preferably inhibited from interacting with curved portions 32. Thus, curved portions 32 are inhibited from producing a significant torque in the counterclockwise direction when water is directed toward roof 2 from nozzle 5. Likewise, nozzle 7 may be offset from the center of central portion 13 and angled to direct water substantially along flow path 40 of curved portions 32 to rotate the roof in a counterclockwise direction (as viewed from above). Water flowing along flow path 40 of curved portion 32 is preferably inhibited from interacting with curved portions 30. Thus, curved portions 30 are inhibited from producing a significant torque in the counterclockwise direction when water is directed toward roof 2 from nozzle 7.

The radially inward portions 34 of the ribs may have a lower height than the radially outward portions 36. In this manner, the radially inward portions tend not to block water directed at the radially outward portions from the nozzle(s). Alternatively, the nozzles may be positioned above or below the roof and angled to direct water above or below radially-inward portions 34 so that it may reach radially outward portions 36. Alternatively, the radially inward portions may be absent.

In all of the embodiments described herein, nozzles 5 and 7 may be directionally adjustable so that the water directed from such nozzles may be directed in different directions without having to alter the positions of conduits 14 and 16. The nozzles may be directionally adjusted manually or with a controller system that is electrically, pneumatically or manually operated. In an embodiment, the water fountain system includes a single nozzle that may be adjusted to direct water towards roof 2 in at least two directions such that the nozzle can cause the roof to be rotated in a clockwise or counterclockwise direction. The nozzle is preferably adjustable using a controller system so that a participant proximate ground level may change the direction from which water is directed at the roof.

Figure 11:
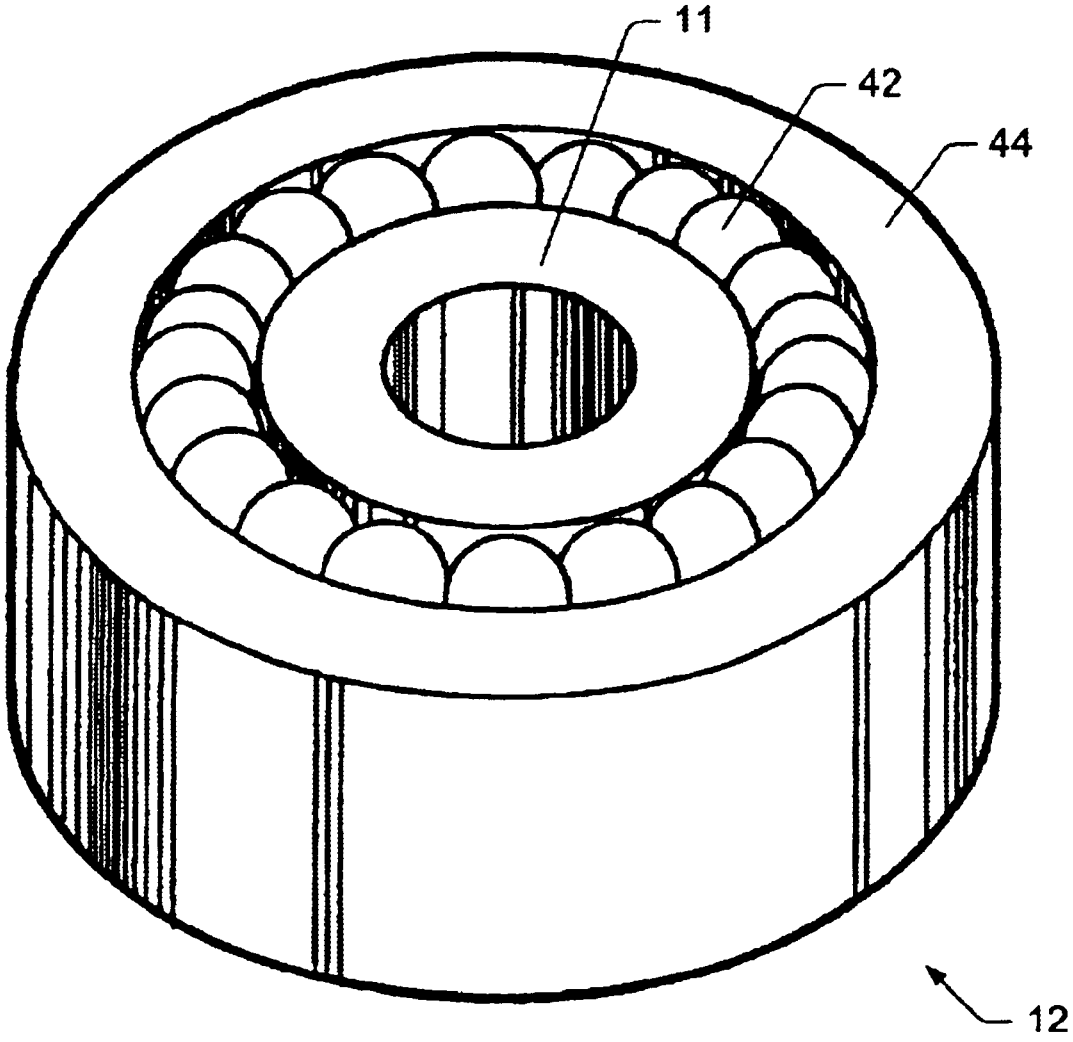
FIG. 11 is a cross-sectional view along a horizontal plane through a bearing of a water fountain system.

FIG. 11 illustrates a horizontal cross-section of bearing 12. Lip 11 of roof 2 is preferably a cylindrical shell seated within bearing 12. Its outer surface preferably contacts spinnable objects 42. These spinnable objects 42 may be in the form of balls or drums encased within a race 44. Race 44 preferably surrounds spinnable objects 42. When a jet of water hits roof 2 at an angle, lip 11 preferably rotates since objects 42 may rotate as lip 11 rotates. Little or no friction preferably exists between spinnable objects 42 and lip 11. In another embodiment, a bushing may be used instead of a bearing. In such an embodiment, the inner surface of the bushing is preferably lubricated to reduce friction between the bushing and the lip.

Each of the above-described water fountain systems may include a light system and a sound system 23 as illustrated in FIG. 1. The light system preferably includes lights 46 which may be located near or on roof 2. A controller system 21 may be electrically coupled to lights 46 and sound system 23. In an embodiment, the controller system 21 includes a computer for transmitting and receiving electrical signals for coordinating operation of one or more valves 10, the lights 46, and sound system 23. The controller system 21 may turn different lights 46 and/or sound system 23 on and off randomly or at predetermined times. The controller system 21 may adjust valve 10 randomly or at predetermined times. In an embodiment, the controller may be programmed to operate the water fountain system when no participant input has been received for a predetermined amount of time. In this manner, the water fountain system may be operated in an "attract" mode to draw the attention of people in the vicinity of the fountain. Alternatively, controller system 21 may activate the lights in response to valve 10 being automatically or manually adjusted. Controller system 21 may also be connected to sound system 23 located near the water fountain system. Adjustment of valve 10 may cause sound system 23 to be activated. Upon activation, sound system 23 may play music, or may only make a sound effect. For example it may play a whistle sound, animal sound, horn sound, etc. Alternatively, sound system 23 may play music or sound effects at predetermined times so that the adjustment of valve 10 is not required for the sound system to be activated.

III. Water Cannon System

Figure 19:
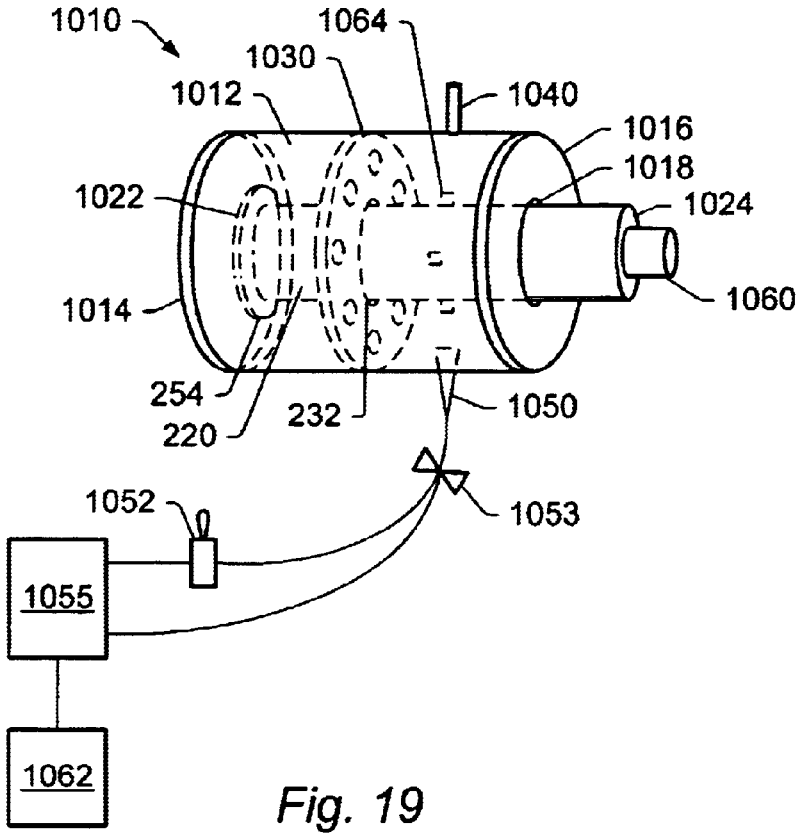
FIG. 19 is a side view of an embodiment of a water cannon.

Turning to FIG. 19, a perspective view of an embodiment of a water cannon 1010 is shown. The water cannon may include a first hollow member or reservoir 1012, having a closed end 1014 and an opposing end 1016. The opposing end 1016 provides an opening 1018 through which a second hollow member or channel 1020 may be disposed. The second hollow member preferably has opposing open ends 1022 and 1024, such that, during use, open end 1022 is disposed inside the first hollow member 1012, and open end 1024 is disposed outside of first hollow member 1012. Open end 1024 may, in certain embodiments include a hollow projection or nose 1060, in open communication with the second open end 1022, such that a fluid flowing into the second open end 1022 would flow out the projection or nose 1060. Alternatively, the open end 1024 may include a flat end with an opening therein. The opening in open end 1024 may be the same size as and contiguous with the hollow interior channel of hollow member 1020, or the opening may be narrower, or larger. It is also understood that a narrowing structure may project into the hollow member 1022. In certain embodiments an opening in the second hollow member 1020 may be at least partially covered by a screen.

When member 1020 is disposed within the opening 1018, preferably an airtight and watertight seal is formed between member 1020 and member 1012 at the opening 1018. The members may be rigidly and/or permanently sealed, as with a weld or other permanent joint, or they may be sealed with the use of a gasket and/or sealant such as silicone or glue.

The embodiment of a water cannon 1010 may further include a planar or disc shaped member, the partition member 1030. The partition member 1030 provides an opening 1032 such that the second hollow member 1020 is able to fit within the opening 1032 and the partition member 1030 is freely slidable along the second hollow member 1020. The device may also include a stop 1054 attached to the second hollow member 1020, near open end 1022, to prevent the partition member 1030 from sliding off the second hollow member 1020 during use. The stop 1054 may be a separate piece attached to the second hollow member 1020, or to the first hollow member 1012, or it may be a ridge, bump, projection or a series of projections formed into the first hollow member 1012 or second hollow member 1020 that is effective to prevent the partition member 1030 from sliding off the second hollow member 1020 during use. In certain embodiments, the stop 1054 may be attached to or formed as a combination of attachments to, or projections in, the first and second hollow members 1012, 1020. In certain embodiments, in which open end 1022 is positioned so close to end 1014 that a partition member 1030 is too large to slip off second hollow member 1020, a stop is not needed. In addition, in those embodiments in which a gas inlet 1050 is attached to end 1016, a stop 1064 is not needed.

The first hollow member 1012 may also include one or more inlets 1040 for a liquid such as water. An inlet 1040 may further include a valve (not shown) to control the flow of water or other fluid into the first hollow member 1012. The valve may be passively operational such that the valve automatically closes when the fluid level in the reservoir reaches a certain level, and the valve opens when the fluid level falls below that level. The valve may also be operated by an operator of the water cannon, or may be operated by a timer or the controller system. The inlet 1040 is preferably in fluid communication with a fluid source, such as a water source, and the source may, in certain embodiments include a pump for moving fluid from the source into the inlet.

The reservoir 1012 may also include one or more gas inlets 1050 disposed during use between the end 1016 of the reservoir 1012 and the partition member 1030. The gas inlets 1050 are, in certain embodiments, connected to the control or switch 1052, which may be connected to a source of compressed gas or compressed air. Switch 1052 may be opened and closed to cause the reservoir 1012 to become filled with gas. During use, opening the switch 1052 may allow gas to flow into the chamber, causing an increase in gas pressure to be produced within the chamber. This increase in gas pressure preferably causes the partition 1030 to move causing the ejection of a projectile of water. After the projectile has been ejected, switch 1052 may be closed to inhibit flow of gas into reservoir 1012.

In an embodiment, a second switch 1053 may be positioned between switch 1052 and gas inlet 1050. Second switch 1053 may be an air-operated actuator. Second switch is preferably configured to allow the air pressure to build up between switch 1052 and 1053 such that the air is pressurized to an appropriate pressure. To produce a burst of gas, switch 1053 is preferably opened allowing the pressurized gas to escape. After an appropriate burst of gas is ejected, the valve is closed and the air pressure allowed to increase. In this manner, the air line supplies air for only the time required to provide the burst of water. Switch 1052 will serve as a main cutoff switch. During use, switch 1052 will remain open to allow flow of air to reservoir 1012. Switch 1052 may be closed to prevent the water cannon from being used, e.g., during routine maintenance. The use of a dual switch system allows gas from the gas supply system to be conserved and energy use of the device to be reduced.

Switch 1052 and/or switch 1053 may be connected to a controller system 1055. The controller system may be configured to accept remote signals from an activation point 1062. An activation point is a device which generates a signal in response to a participant signal. Examples of activation points include, but are not limited to an electronic switch, a manual switch, a lever, a handle, a wheel, a pressure pad, a button, a trigger, a motion detector, and a microphone. Switches 1052 and/or 1053 may be coupled to an activation point 1062 via the controller system 1055 such that a participant signal delivered to activation point 1062 causes a signal to be sent to controller system 1055. Controller system 1055, upon receiving a signal from activation point 1062, sends a switching signal to the switches 1052/1053 such that the switches are opened. Opening of the switches causes a sequence of events which ultimately produces a water projectile. Signals sent between activation point 1062 and controller system 1055, as well as between the controller system 1055 and the switches 1052/1053 may be either electrical or pneumatic signals. Activation points and participant signals are described in more detail below. The activation points may be located on or in the vicinity of the water cannon. Alternatively, the activation points may be located at a remote location from the water cannon. By placing the activation points at a remote location, a participant may operate one or more water cannons which are located in an inaccessible location, e.g., the top of a play structure or building.

Alternatively, controller system 1055 may be configured to operate the switches 1052/1053 without any participant input. The controller system may be programmed to produce water projectiles at random or predetermined intervals. Based on the programming of the controller system 1055, the controller system will send signals to switches 1052/1053 to initiate the production of a water projectile. The controller system may be configured to continuously operate the water cannon. Alternatively, the controller system may be configured to operate the water cannon system when the activation points are in an idle state, e.g., when no participants are present.

During operation of the water cannon, fluid is allowed to flow in the fluid inlet 1040 and to at least partially fill the reservoir or first hollow member 1012. It is preferred that the fluid fill the reservoir 1012 at least until the fluid level completely covers open end 1022. As fluid reaches the proper level, a valve in the fluid inlet 1040 may be closed or the fluid flow may be stopped by some other means. When the reservoir 1012 is full of fluid, the partition member 1030 is disposed near open end 1024, and may rest against one or more stops 1064. This may be described as the "loaded" cannon configuration. When the cannon is in the loaded configuration, an operator may activate the switch 1052 to release compressed gas or air into an air inlet 1050. The compressed or pressurized gas forces the partition member 1030 to slide down the second hollow member 1020, forcing the liquid into the open end 1022, through the second hollow member 1020 and out open end 1024. Preferably the water cannon is configured such that the diameter of the second hollow member 1020 is no more than about one-third the diameter of the first hollow member 1012. This configuration allows an explosive movement of the partition member 1030 upon activation of the switch 1052 and results in a mass of water being forcefully ejected in a single spurt from the second hollow member 1020.

Figure 20A:
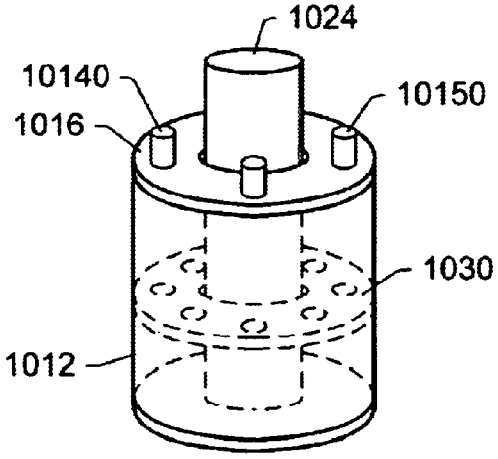
FIG. 20A is a perspective view of an embodiment of a water cannon in a loaded configuration.
Figure 20B:
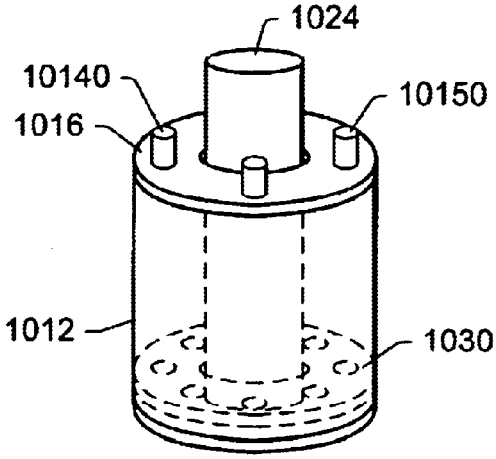
FIG. 20B is a perspective view of an embodiment of a water cannon in a spent configuration.

FIG. 20A is a perspective view of an embodiment of a first hollow member 1012 in a loaded configuration. The partition member 1030 is disposed at least partially up the second hollow member 1020. In the embodiment shown, the end 1016 of the first hollow member 1012 includes an adapter 10140 connected to a fluid inlet 1040 and an adapter 10150 connected to a gas inlet 1050. FIG. 20B is a perspective view of the embodiment shown in FIG. 20A in the "spent" configuration, i.e. after firing. In FIG. 20B, partition member 1030 has been forced down the second hollow member 1020 by an influx of air and has caused ejection of a fluid "projectile."

By "projectile" is meant a discrete volume or mass of water ejected from a water cannon due to a single release of gas into the first hollow member. Preferably a projectile travels through its trajectory as a discrete, or substantially solid mass of water. It is understood that the projectile will break into smaller portions during the course of its trajectory. Nevertheless, the projectile provides a sudden, large impact of short duration when it hits its target, rather than a continuous stream of water, as in previous water gun type devices. A device as described herein, therefore, provides a different, and more fun sensation for a "target" person who is hit with the projectile as compared to a continuous stream. The present devices provide the target or recipient with a sensation more akin to being hit with a water balloon or a bucket of water, rather than with a stream of water such as results from being sprayed with a water gun or water hose. The projectile may have a volume of between about 8 oz. to about 60 gallons, preferably between 1 gallon to about 20 gallons, and more preferably still between 2 gallons and 10 gallons depending on the size of the water cannon.

By adjusting the pressure of the gas burst, the shape of the projectile may also be varied. For example, a high pressure, short burst of gas may cause a more diffuse projectile, while a low pressure, longer burst of gas may cause a more dense projectile. The type of projectile produced may be determined by the gas pressure, the flow rate of the gas, and the dimensions of the first and second hollow members.

Figure 21:
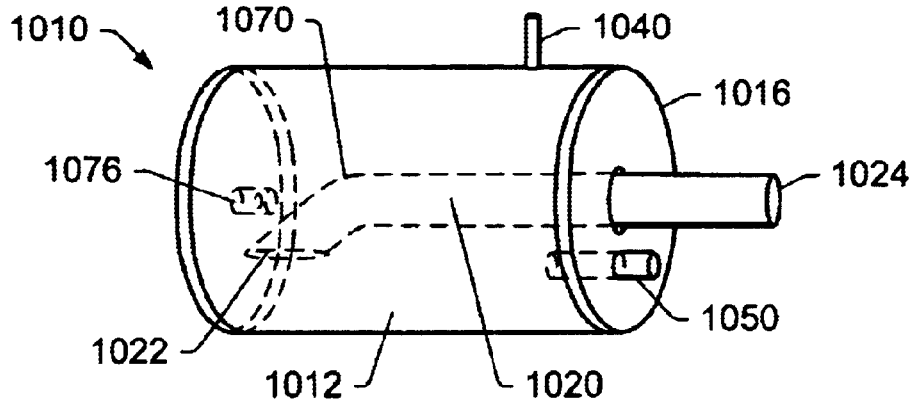
FIG. 21 is a side view of an embodiment of a water cannon.

FIG. 21 depicts an embodiment of a water cannon 1010 in which the second hollow member includes a bend or angle 1070. Although the device shown in FIG. 21 includes a channel member that forms an obtuse angle, a channel member forming a bend or curve, or a larger or smaller obtuse angle, or even a right angle or an acute angle would be encompassed by the present embodiment. It is contemplated that in order to place the open end 1022 further beneath the surface level of a fluid contained in the reservoir 1012, it is advantageous to point the second open end 1022 of the second hollow member 1020 in a downward direction relative to the first open end 1024. In this embodiment, the second hollow member 1020 is configured such that, during use, when the first open end 1024 of the second hollow member 1020 is pointed parallel to the ground, the second open end 1022 of the second hollow member 1020 is positioned lower than the first open end.

Figure 22:
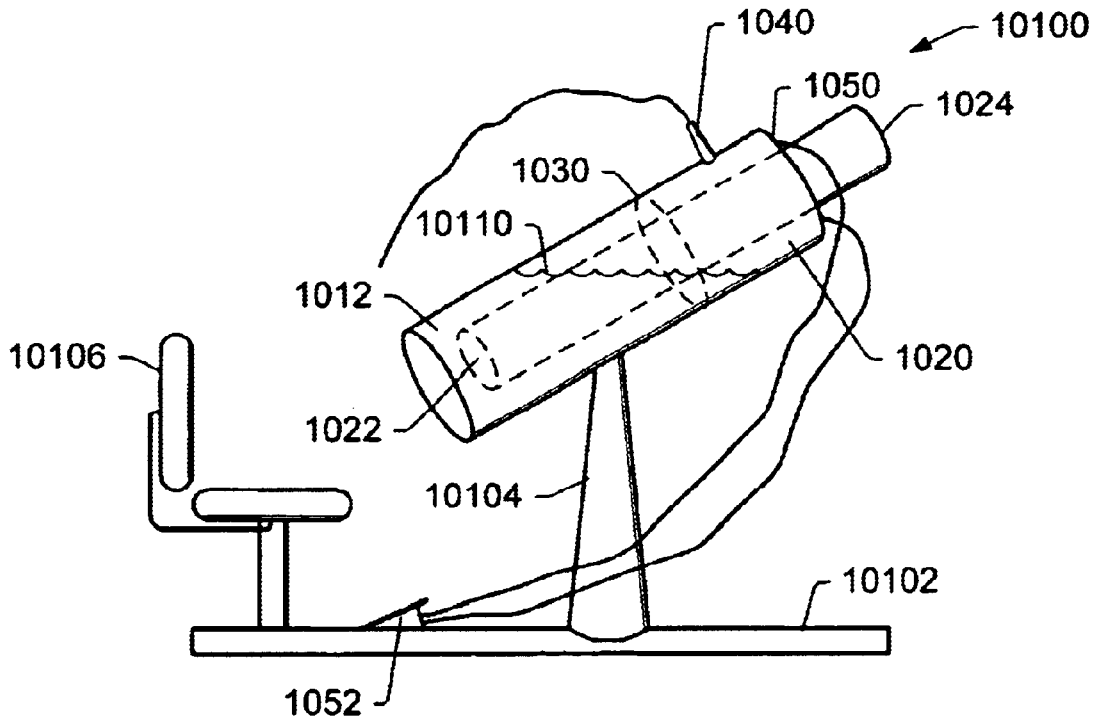
FIG. 22 is a side view of a water cannon that includes a support apparatus.

Turning to FIG. 22, a mounted water cannon 10100 is shown. The mounting configuration includes a base 10102 that may be attached to or resting on the ground, or in a pool of water, for example. An upright member 10104 extends from the stand 10102 to the first hollow member 1012 and supports the water cannon. A seat 10106 is provided for an operator to occupy while operating the water cannon 10100. The upright member 10104 may be rotatably attached to the base 10102 so that the cannon can be swiveled from side to side. In certain embodiments the upright member includes a semispherical attachment that mates with a cup-like structure in the base 10102 such that the cannon may be raised or lowered and swiveled simultaneously. In alternative embodiments, the top of the upright member includes a vertically adjustable connection to the first hollow member effective to raise or lower the cannon during use. In certain embodiments, the upper connection of the upright member to the first hollow member is a semispherical ball and cup connection as described above.

As shown in the figure, an activation point 1052 may be coupled to the water cannon. The activation point may be a foot pedal positioned for easy access by an operator seated in seat 10106. In other embodiments, the activation point 1052 may be an electronic switch, a manual switch, a lever, a handle, a wheel, a pressure pad, a button, or a trigger, for example. The switch may be operated by a participant, or may be automatically operated by a controller system. The water cannon may further include a sight, typically positioned on an upper or side surface of the first hollow member in order to more closely resemble a cannon. The device is contemplated to be most effective at projecting a "blob" or mass of water or other fluid when the device is tilted such that the end 1024 is pointed at a somewhat upward angle as shown. As is seen in the drawing, the fluid level 10110 is above the second open end 1022 in the loaded configuration.

Any of the devices described herein may be used in combination to form an array of water cannons in various configurations. For example, two or more water cannons may be set up as opposing sides, such that the operators of one set of cannons may fire at the operators of an opposing set and vice versa. In certain embodiments, the water cannons of opposing sides may fire water or other fluid of different colors so that non-adjacent cannons can be designated or recognized as being on a side. In other embodiments, a single water cannon may include multiple barrels or multiple cannons operated by a single operator or even a single control mechanism so that an operator may achieve a rapid-fire effect. Alternatively, the water cannon may be configured to produce multiple projectiles of water. When the control mechanism is switched by an operator, the water cannon may produce multiple water projectiles, either one after another or all at once. When the multiple projectiles are produced one after another, the water cannon may continue producing water projectiles until the control mechanism is no longer switched on.

Figure 23:
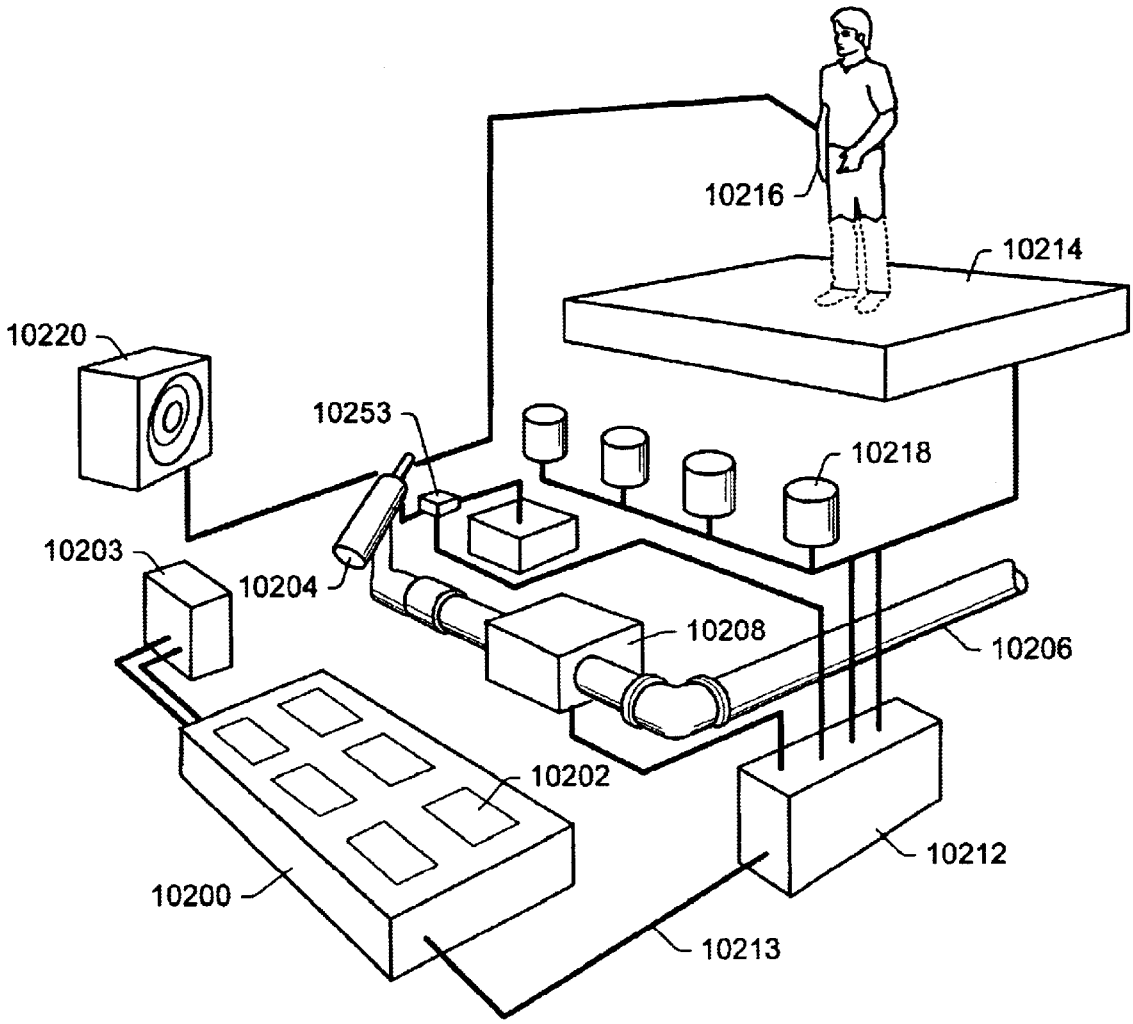
FIG. 23 is a perspective plan view of one embodiment of a musical water fountain system having a sound system.

In an embodiment, a water cannon system which includes one or more water cannons, may be incorporated into a musical water fountain system. An embodiment of a musical water fountain system is depicted in FIG. 23. The musical water fountain system preferably includes a sound system 10203 for playing musical notes, a water cannon 10204 for producing projectiles of water, and a lighting system adapted to activate lights 10218. The sound system, water cannon system, and lighting system are preferably activated by a participant such that the timing of the visual, water and sound effects created by such systems are dependent upon physical acts of the participant.

Figure 24:
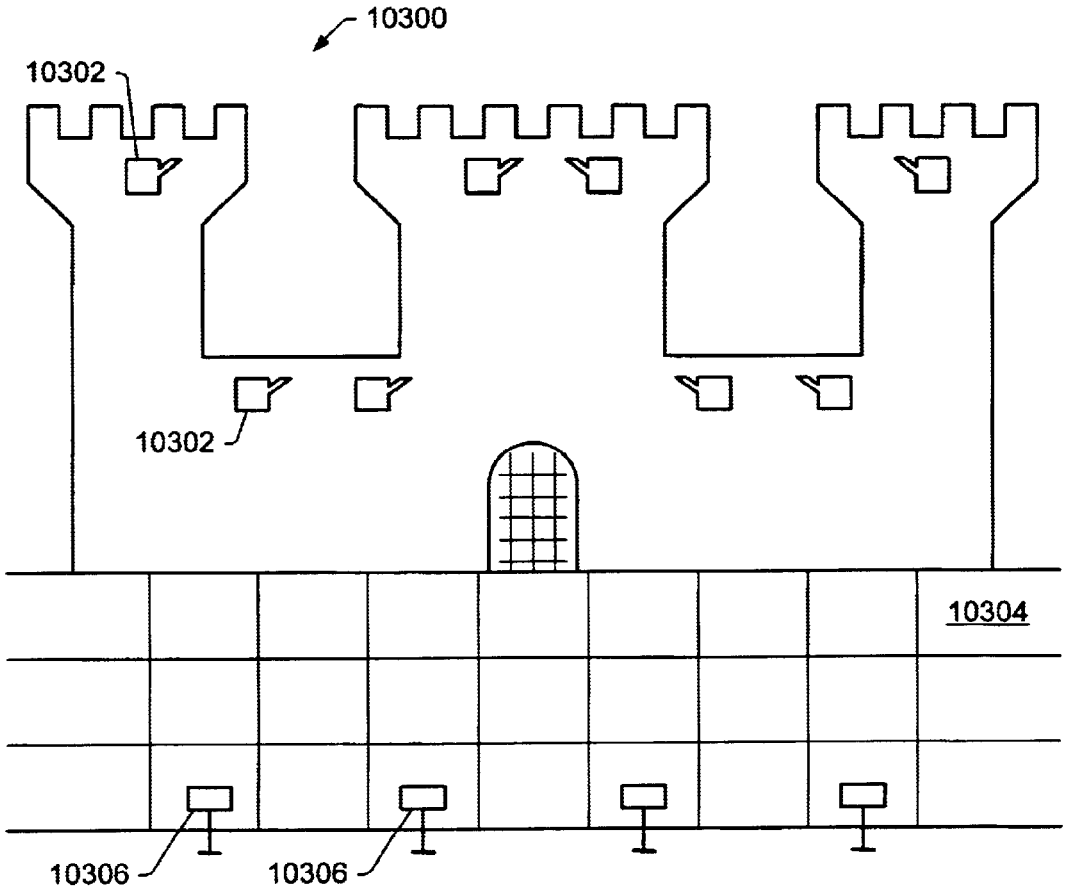
FIG. 24 is a front view of a water structure which includes a water cannon.

FIG. 24 depicts a structure 10300 which has a number of water cannons associated therewith. The structure may be a castle (as depicted), a boat, a house, a fort, a pace ship, etc. A number of water cannons 10302 are placed about the structure. Participants may enter the structure and activate the water cannons to shoot water at people arranged upon outer grid 10304. The grid may include markings which may allow the participants operating the water cannons 10302 to aim the water. For example, the water cannons 10302 may include a guide for allowing the participants to aim at a specific region of the grid. When a person enters the specific region of the grid, the participant may activate the water cannon causing the cannon to project water onto the person. Alternatively, the structure may be configured to hold only the water cannons 10302. Activation points 10306 may be remotely coupled to the water cannons. The activation points are preferably configured to produce a signal to alert the controller system of a participant signal; the controller system may cause the water cannon to fire a projectile of water in response to a participant signal. The activation point may activate one or more of the water cannons 10302 causing a projectile of water to be sent onto the grid 10304. The activation points 10306 may also allow the water cannon to be remotely aimed at a specific grid. The participant may therefore "aim" the cannon at a specific region of the grid using the activation device and, subsequently, create a signal causing the water cannon to fire a projectile at the grid.

IV. Musical Water Fountain System

Figure 12:
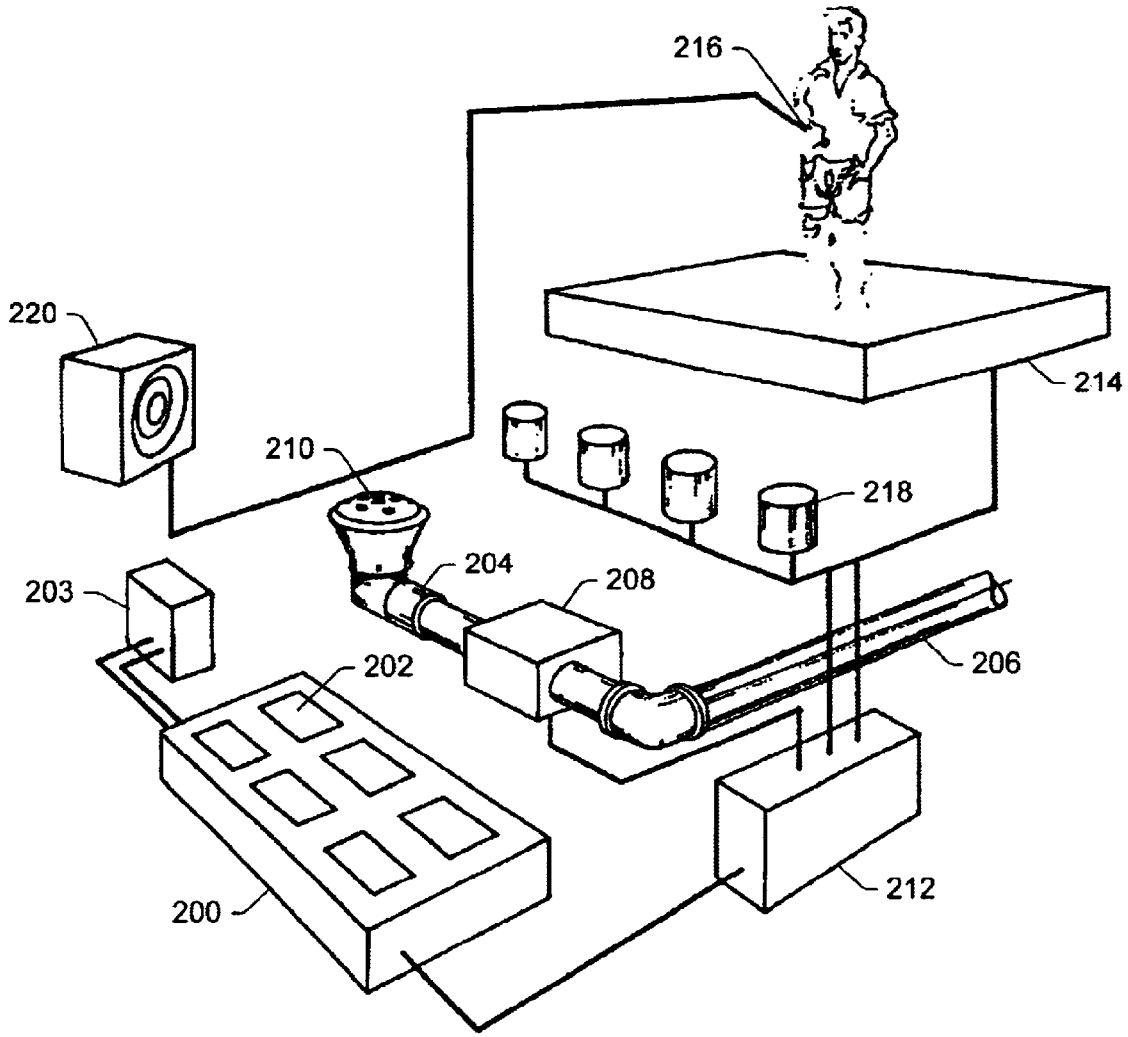
FIG. 12 is a perspective plan view of one embodiment of a musical water fountain system having a sound system.

An embodiment of a musical water fountain system is depicted in FIG. 12. The musical water fountain system preferably includes a sound system 203 for playing musical notes, a fountain system 204 for spraying water, and a lighting system adapted to activate lights 218. The sound system, fountain system, and lighting system are preferably activated by a participant such that the timing of the visual and sound effects created by such systems is dependent upon physical acts of the participant.

The musical water fountain system preferably includes at least one instrument 200 included in an "orchestra". In an embodiment, participants apply a participant signal to activation points 202 to activate the instruments. The participant signal may be applied by the application of pressure, moving a movable activating device, a gesture (e.g., waving a hand), or by other means. The activation point is preferably configured to respond to the participant signal. In one embodiment, the activation point may be configured to respond to a participant's touching of the activation point. The activation point may respond to varying amounts of pressure, from a very light touch to a strong application of pressure. Alternatively, the activation point may include a button which is depressed by the participant to signal the activation point. In another embodiment, the activation point may include a movable activation device. For example, the activation point may be a lever or a rotatable wheel. The participant may then signal the activation point by moving the lever (e.g., reciprocating the lever) or rotating the wheel. In another embodiment, the activation point may respond to a gesture. For example, the activation point may be a motion detector. The participant may then signal the activation point by creating movement within a detection area of the motion detector. The movement may be created by passing an object (e.g., an elongated member) or a body part (e.g., waving a hand) in front of the motion detector.

The activation points 202 are preferably located on or in the vicinity of the instrument 200. Each instrument 200 may include a plurality of activation points 202. For example, the instrument may be a piano or a keyboard containing a plurality of keys wherein each of the keys includes an activation point 202 (see FIG. 13). Each of the activation points 202 is preferably configured to cause sound system 203 to play a different sound. In an embodiment, the fountain is adapted to create musical notes. Sound system 203 may be used to increase the volume of and/or alter the sound quality of the musical notes created by the instrument. Sound system 203 may include a speaker to increase the volume of the musical note being played. Alternatively, the musical notes may be pre-recorded and generated by sound system 203, while the instruments may serve to contain the activation points without actually playing the musical notes. Alternatively, the sound system may make sound effects. For example, the sound system may produce a whistle sound, animal sound, horn sound, etc. In another embodiment, sound system 203 may be a mechanical device configured to produce sounds or musical notes when activation points 202 are signaled.

In one embodiment, each of activation points 202 is preferably configured to sense a participant signal and generate one or more signals in response to the participant's signal. The signals generated by the activation point may be electronic or pneumatic. Each of the activation points is preferably electrically coupled to a controller system 212. Controller system 212 is preferably an electronic controller system configured to process the signals from the activation points and send corresponding output signals to the sound system, lighting system, and/or fountain system. For instance, each time a participant's signal is applied to an activation point, a first signal is preferably relayed to a sound system 203 via controller system 212. The first signal preferably indicates to sound system 203 a particular musical note to play, depending on the activation point from which it originated.

Furthermore, when a participant signals an activation point, a second signal may be relayed to a fountain system 204 via controller system 212. In response to the second signal, the fountain system 204 may produce a fountain effect. Examples of fountain effects include spraying of water, generation of bubbles, and generation of smoke. The fountain effect of spraying water may include varying the height, direction, and/or volume of the water produced by the fountain when certain activation points are signaled. Fountain system 204 preferably includes at least one conduit 206, at least one valve 208 disposed within conduit 206, and at least one nozzle 210 connected to conduit 206 for producing a spray of water. Conduit 206 may be made from materials such as PVC or galvanized steel. The valve 208 is preferably electrically coupled to controller system 212. The second signal may be relayed to valve 208 to signal it to open, thereby causing water to be sprayed from nozzle 210.

In an embodiment, a lighting system 218 is located near fountain system 204. When a participant signals an activation point a third signal may be generated by controller system 212. The third signal may be relayed to a lighting system 218, thereby activating selected lights of the lighting system.

It is to be understood that the first, second, and third signals described herein may each be taken to mean a single signal or may represent a series of signals. For instance, an activation point may generate a signal and send it to controller system 212. In response controller system 212 may transmit a signal to the sound system to produce a musical note. For simplicity, the "first signal" may be taken to include the signal generated by the activation point and the signal relayed by the controller system.

Each of the activation points may be configured to generate the first, second, and third signals each time a participant's signal having a predetermined magnitude is sensed by the activation point. For pressure activated points, the signals may be generated in response to a predetermined amount of force applied to the activation point. For motion-activated points, the signals may be generated in response to movement having a speed within a predetermined range.

Alternatively, each activation point 202 may correspond to either the sound system, fountain system, or lighting system. That is, the activation points 202 may be configured to generate either the first, second, or third signal such that a participant can separately activate the sound system, fountain system, and lighting system by applying a signal to different activation points 202. Activation points 202 may include transducers for sensing the magnitude of the signal applied to the activation points. Activation points 202 may selectively generate the first, second, and/or third signals as a function of the magnitude of the signal applied to the activation point. In this manner, the participants may control which of the sound system, fountain system, and light system may be activated by controlling the magnitude of the signal applied to the activation point. For instance, a pressure sensitive activation point may generate the first signal to activate the sound system in response to sensing a force below a predetermined magnitude, while the activation point may generate the second and/or third signals in response to sensing a force above the predetermined magnitude.

In an embodiment, the sequence in which a participant signals the activation points affects the resultant sound quality of the music generated by sound system 203. For instance, the sequence in which participant signals are applied to the activation points may determine the order in which the musical notes are played by sound system 203. In an embodiment, various indications are provided by the controller system to participants at predetermined times to coordinate the activation of the sound system, fountain system, and lighting system to create a desired visual and audio display. The participants preferably apply a participant signal to an activation point immediately after receiving an indication at a pre-determined time.

The indication provided to the participants may be supplied by an electrical indicator that is coupled to a controller system 212. The controller system preferably activates the electrical indicator at predetermined times or in response to a signal from a proximity sensor located near the activation point. The indication may be a visual signal (e.g., light), an audio signal (e.g., a tone), or a tactile signal (e.g., a vibration). The indication may be located in the vicinity of the activation point. In an embodiment, a separate indicator is produced to indicate to a participant when to apply a participant signal to activation points to separately activate the sound system, lighting system, and fountain system.

Alternatively, the indication may be provided by a conductor 216. As described herein, "conductor" is taken to mean any object or mechanism for coordinating the actions of the participants to create desired visual and/or sound effects by activating the sound system and/or lighting system and/or fountain system. The conductor may be an individual that motions and/or speaks to participants to signal the participants when to apply a participant signal to an activation point. The conductor may speak into a microphone, and the volume of the conductor's voice may be increased by a speaker 220 directed toward the participants. Individual speakers 220 may be located proximate each instrument or set of activation points corresponding to an instrument so that the conductor may communicate to selected participants at different times. Alternatively, the conductor may be a robotic arm for directing the participants. In an embodiment, the conductor may be a projected image. For instance, different colors or images may be displayed on the screen at predetermined times, wherein each color or image corresponds to a different instrument or group of instruments. The display of a particular color or image may indicate to selected participants to apply a participant signal to selected activation points. Platform 214 preferably supports conductor 216. Platform 214 is preferably at an elevational level above the participants and activation points 202 so that the participants may easily see conductor 216. The controller system 212 may be configured to control the conductor signals and/or the display screen images.

Figure 13:
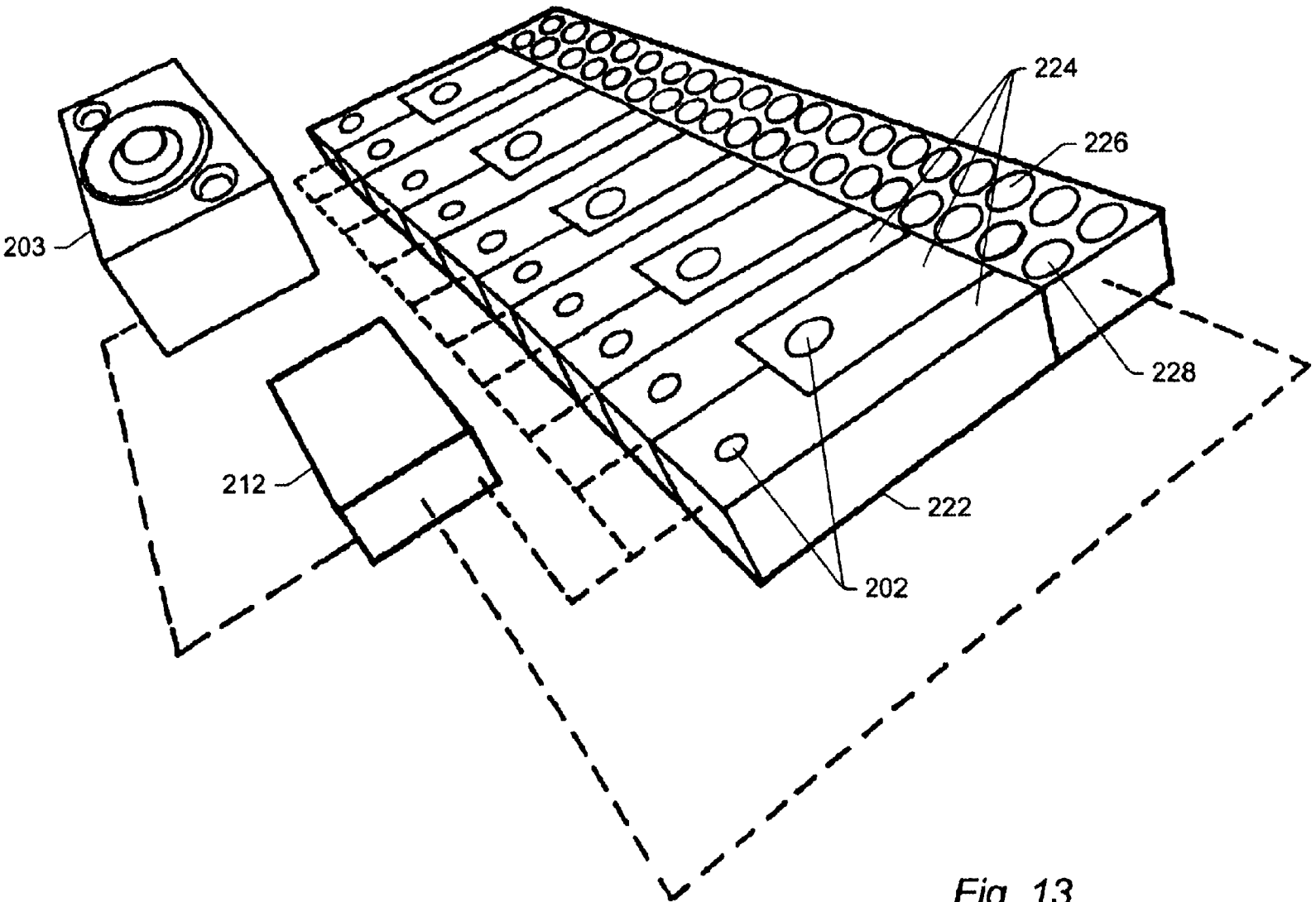
FIG. 13 is a perspective plan view of a keyboard which is an element of a sound system.
Figure 14:
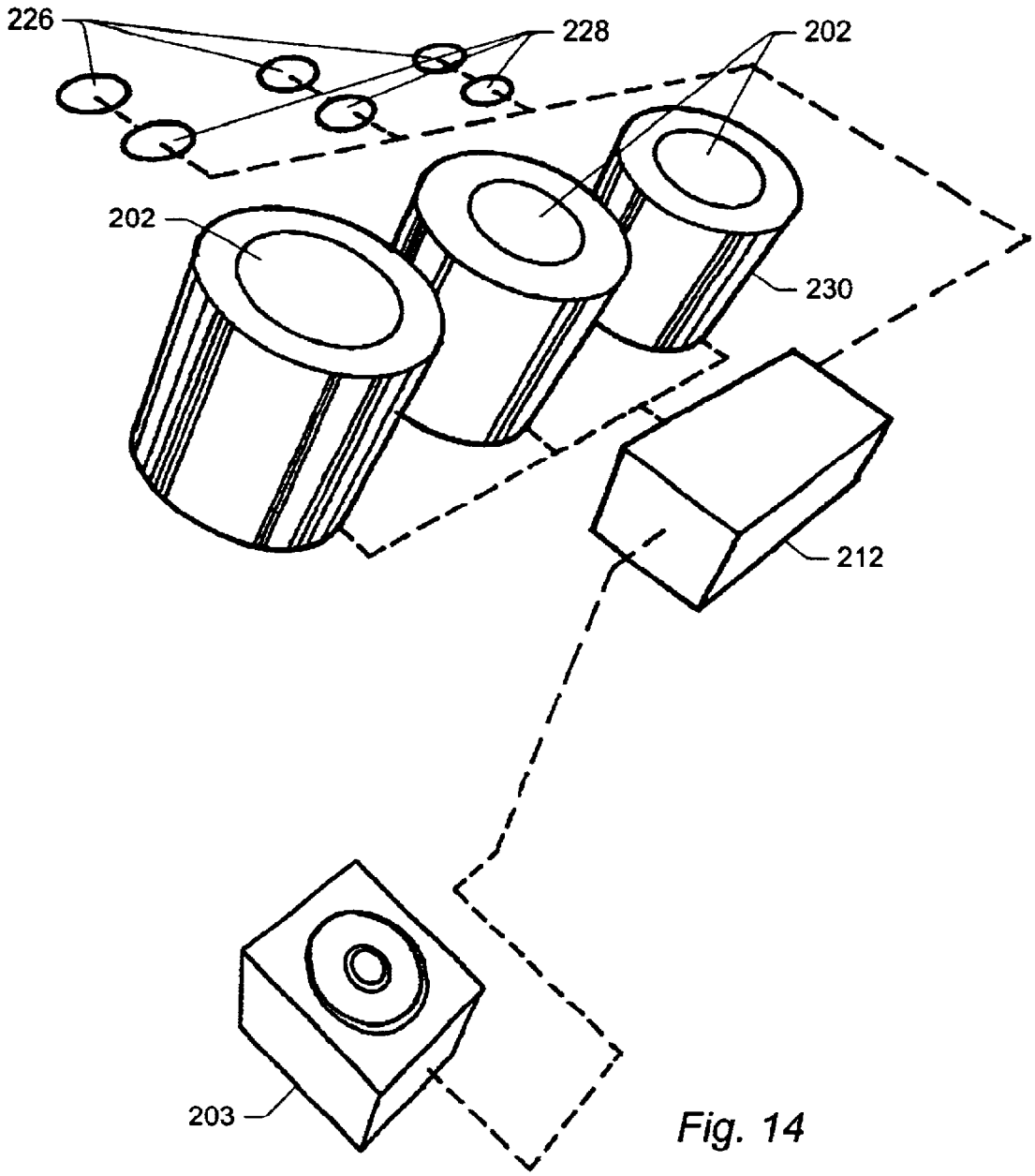
FIG. 14 is a perspective plan view of a drum set which is one element of a sound system.
Figure 15:
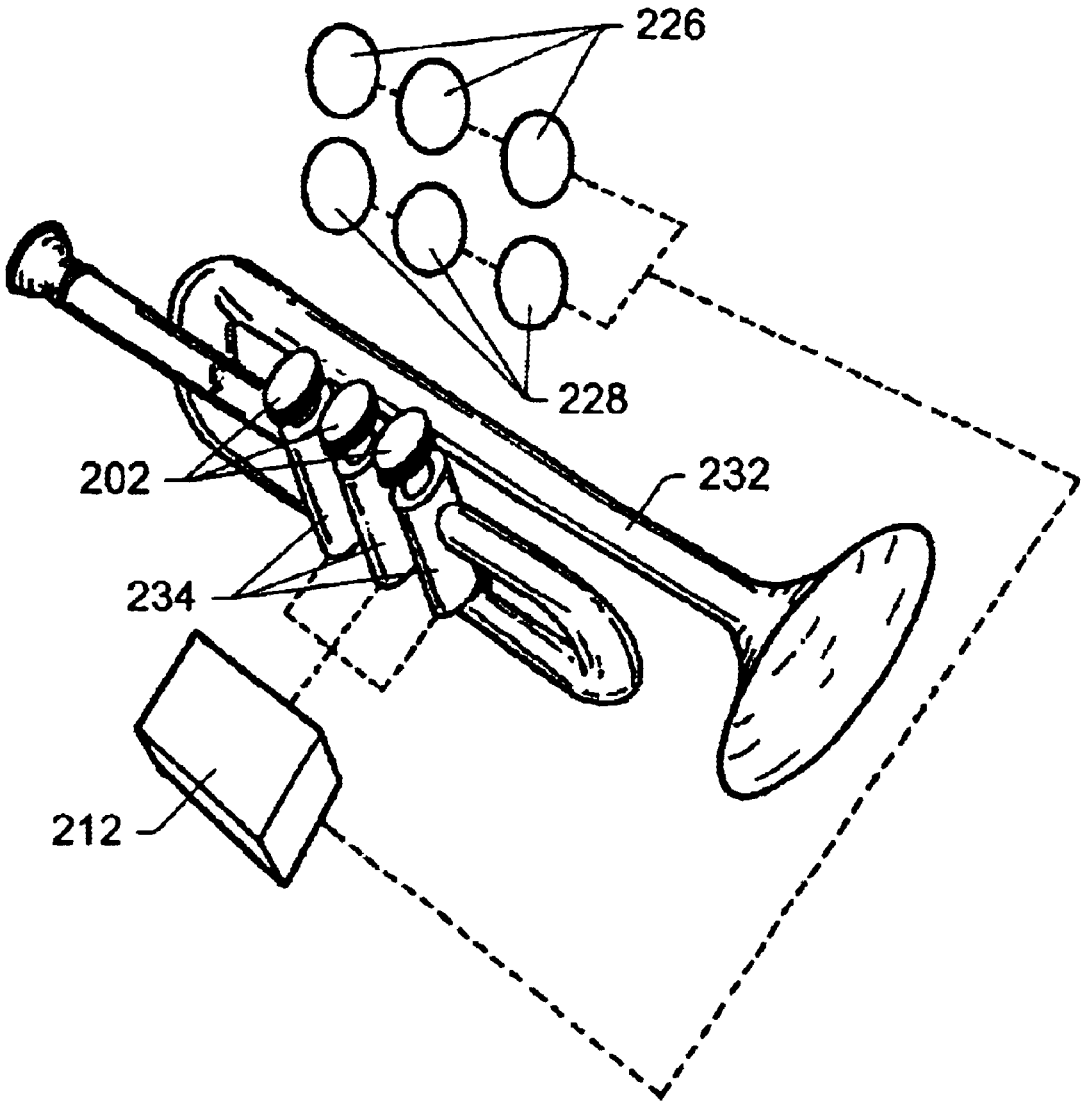
FIG. 15 is a perspective plan view of a trumpet which is one element of a sound system.
Figure 16:
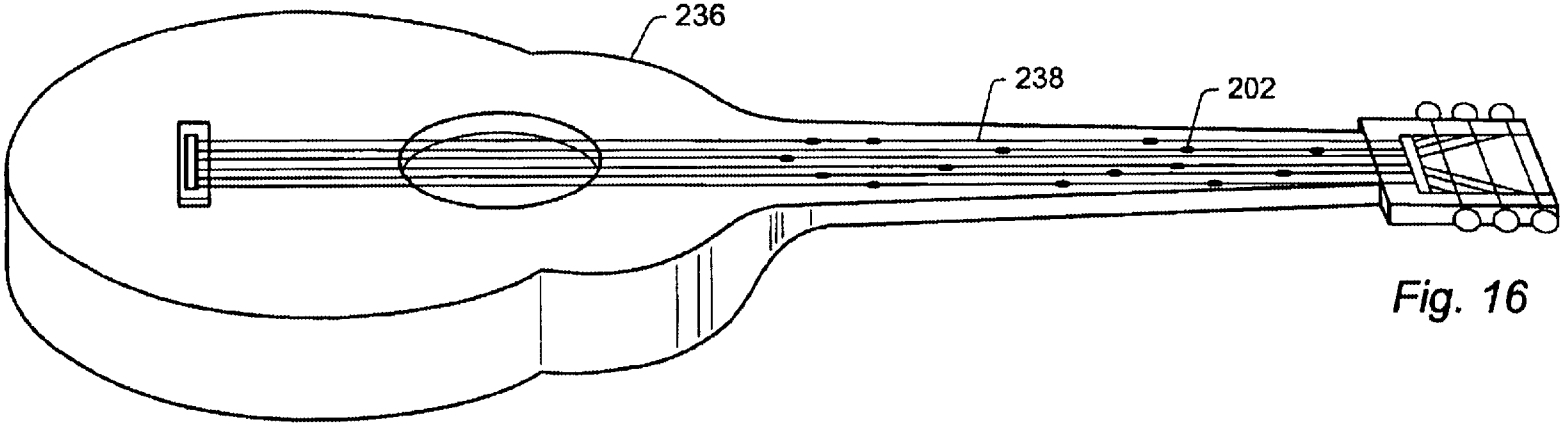
FIG. 16 is a perspective plan view of a guitar which is one element of a sound system.
Figure 17:
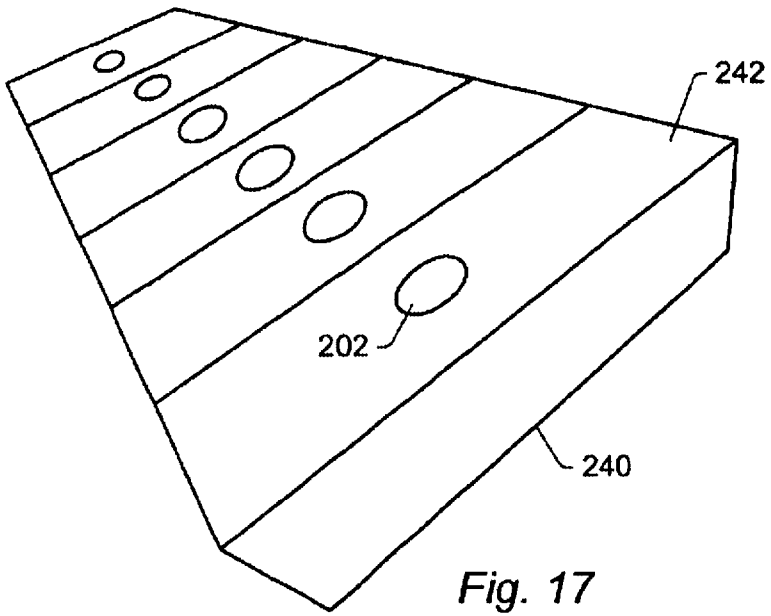
FIG. 17 is a perspective plan view of a xylophone which is one element of a sound system.

FIG. 13 illustrates one type of instrument which may belong to the "orchestra" of instruments activated by the participants. This instrument is a keyboard 222 having a plurality of keys 224. Each key 224 preferably includes an activation point 202 that is electrically coupled to controller system 212. In an embodiment, keys 224 are large enough to support a participant standing thereon. In an embodiment, the weight of a participant serves as a force applied to a pressure sensitive activation point 202 to generate a participant signal. Activation point 202 preferably senses the force and generates a first signal and a second signal. Controller system 212 may relay the first signal to a sound system 203 that may produce the appropriate note for the pressure point (e.g., key) contacted on keyboard 222. Controller system 212 may also send the second signal to a fountain system (not shown) to cause water to be sprayed from the fountain. The water may be sprayed as a result of the opening of a valve in response to the second signal, as described above.

A visual indicator, for example, lights 226 and 228 may indicate when a force should and should not be applied to a certain pressure point. Lights 226 and 228 may be coupled to controller system 212 which activates the lights at appropriate times. One of the lights preferably indicates when a participant should apply a force onto (e.g., stand on) one of the activation points 202 while another light preferably indicates when the participant should discontinue application of force onto the activation point. A musical note or sequence of musical notes may be played by sound system 203 in response to various participants applying forces to activation points 202. It is to be understood that lights 226 and 228 may be different colors. In one embodiment, light 226 is red and light 228 is green. In an alternative embodiment, a single light may be activated to indicate to a participant to apply a force to an activation point. The light may be one of a variety of colors, such as yellow, green, red, blue, purple, and orange. After the participant has applied force to the activation point the light may be turned off by controller system 212 to indicate when the participant should discontinue applying force to the activation point.

FIGS. 14–17 depict a drum set 230, a trumpet 232 (horn), a guitar 236, and a xylophone 242, respectively. These instruments as well as other instruments may be included in the musical water fountain "orchestra". They preferably operate in a similar manner to keyboard 222 of FIG. 13. Activation points 202 may be located on each drum 230, on each playing valve 234 of trumpet 232, on each string 238 of guitar 236, and on each key 242 of xylophone 240. A participant may apply a force to an activation point by standing on it or by contacting it with a finger or hand. The activation points 202 may be in the form of a button, a lever, etc.

Figure 18:
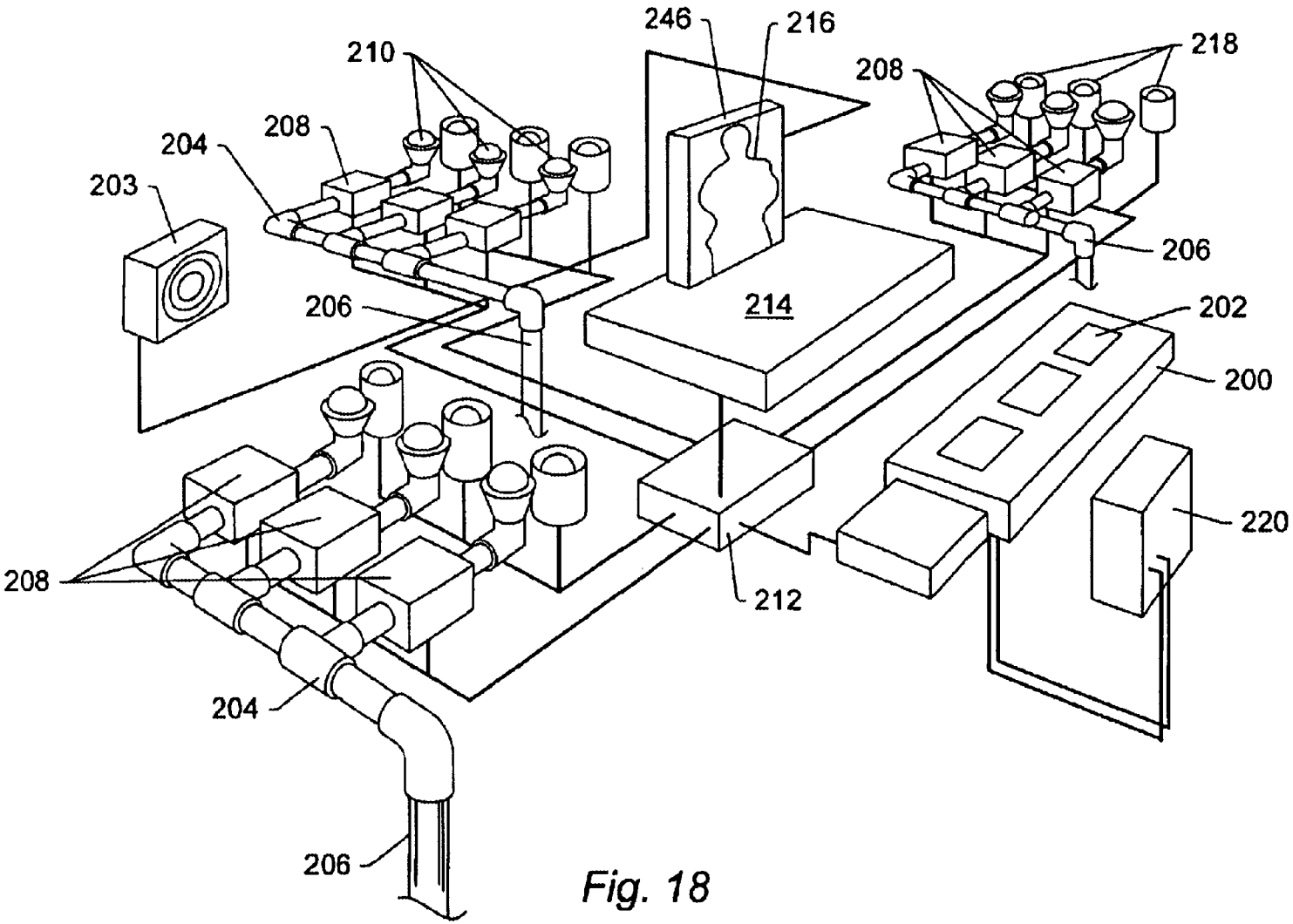
FIG. 18 is a perspective plan view of an embodiment of a musical water fountain system having a plurality of fountain systems.

FIG. 18 illustrates an embodiment of a water fountain system having a plurality of fountain systems 204. This embodiment preferably includes the same features of the previous embodiment with some alternatives. Each fountain system 204 preferably includes a conduit 206, valves 208, and nozzles 210, allowing water to spray in a multitude of directions. Conductor 216 may be an image projected onto a screen 246 (television or movie screen) so that a person or robot need not be present to conduct music. Screen 246 is preferably positioned on platform 214 so that participants in the "orchestra" may see it. A participant may apply a participant signal to a particular activation point 202 in response to receiving an indication from an electrical indicator at a pre-determined time. Upon sensing the force, controller system 212 preferably generates signals that are relayed to sound system 203, one of the fountain systems 204, and/or one of the light systems 208. In response to receiving a signal from controller system 212, sound system 220 may produce a musical note, one or more of valves 208 may open to spray water, and certain lights 225 may become activated. The lights that are activated are preferably in close proximity to the fountain system from which water is being sprayed. The cooperative effort of the participants at each of the individual fountains may create a pleasant musical tune and/or visual display (lights and/or water displays).

In an embodiment, controller system 212 receives the signals generated in response to the participant's signals being applied to the activation points 202. Controller system 212 then indicates to the sound system the appropriate time to play a particular note. The computer preferably controls operation of sound system 220 such that the resultant music is affected by the presence of particular first signals and the order in which such signals are relayed to controller system 212. In this manner, whether or not a participant applies a signal to an activation point 202 and the time at which a participant applies a signal to one or more activation points may affect the music produced by sound system 203. Controller system 212 may receive the participant signals from activation points 202 and delay playing of sounds by sound system 203 for a predetermined time (e.g., ten seconds or more). Alternatively, sound system 203 may play a musical note substantially immediately upon receiving the first signal. In an alternative embodiment, controller system 212 may be programmed to cause a sequence of notes to be produced at a particular time so that a song is correctly played even when the participants do not contact activation points 202 at appropriate times. Alternatively, controller system 212 may be programmed to cause a song to play after a predetermined time with no participant signal.

In another embodiment, a single fountain system may include a plurality of different activation points for producing various sounds, lights, and/or fountain effects. Each of the activation points may activate an instrument, or some notes of an instrument when a participant signal is applied to the activation point. A conductor may be used to signal the activation of the instruments or of specific notes of the instruments. A group of participants may respond to the conductor's indications such that a musical tune is produced.

In another embodiment, water from the musical fountain may be used to create the sounds produced by the musical fountain system. For example, a plurality of activation points may be disposed about a fountain system. The activation points are preferably coupled to a water spray system. The water spray system may be a water cannon system as described above. In response to a participant's signal, the activation point preferably causes a stream of water to be fired which then impacts a sound-producing device. The impact of the water stream against the sound-producing device preferably produces a sound. For example, the sound producing device may be a series of gongs which, when struck with a water stream, produces a ringing sound. Other sound devices, which may produce a sound when contacted with water include, but are not limited to percussive instruments (e.g., drums), bells, tubes, and chimes.

In another embodiment, the musical fountain system may be a bubble organ. The bubble organ preferably includes a series of pipes arranged in a manner that is typical of a pipe organ. The pipes are preferably made of a substantially transparent material. A series of activation points may be disposed about the bubble organ. In response to a participant's signal, the activation point preferably produces an organ like sound while simultaneously producing a fountain effect. Preferably, the fountain effect includes the production of bubbles, such that bubbles emanate out of a top portion of the pipes. A lighting system may also be coupled to the pipes such that the participant's signal activates the light such that the bubbles appear to be colored as they move through the pipe.

In another embodiment, the musical fountain may be constructed in the form of a walkway. A plurality of activation points are preferably arranged on the surface of the walkway such that participants may step on the activation points. The activation points are preferably configured to respond to the weight of the participants. As the participants move along the walkway, they may contact the activation points such that a musical and/or a fountain effect is produced. For example, when a participant steps on an activation point, a portion of a song may be played by a sound system coupled to the walkway. Additionally, a fountain effect, such as a stream of water, may be produced.

Other rides which may be found in a wet or dry park may also be present.

Each of the inventions I–IV discussed above may be used individually or combined with any one or more of the other inventions.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A system comprising:

a water system configured to produce a water effect;

a control system coupled to the water system, wherein the control system is configured to generate one or more water system control signals to activate the water system to produce the water effect; and an activation point coupled to the control system, wherein the activation point is configured to receive one or more participant signals and send one or more activation signals to the control system;

wherein the control system is configured to generate the water system control signals in response to the activation signals, and wherein the control system is further configured to generate the water system control signals in the absence of activation signals.

2. The system of claim 1, wherein the water system comprises a water effect generator, a conduit for carrying water to the water effect generator, and a valve disposed in the conduit, the valve configured to control the flow of water through the conduit, and:wherein the valve is operable in response to the water system control signals generated by the control system.

3. The system of claim 1, further comprising an indicator configured to provide an indication to the participant to apply a participant signal, wherein the indicator is coupled to the control system and positioned proximate to the activation point, and wherein the control system is further configured to produce an indicator control signal to activate the indicator at predetermined times during use.

4. The system of claim 1, further comprising an indicator configured to provide an indication to the participant to apply a participant signal, wherein the indicator is coupled to the control system and positioned proximate to the activation point, and wherein the control system is further configured to produce an indicator control signal to activate the indicator at predetermined times during use, and wherein the indicator produces a visual indication during use.

5. The system of claim 1, further comprising an indicator configured to provide an indication to the participant to apply a participant signal, wherein the indicator is coupled to the control system and positioned proximate to the activation point, and wherein the control system is further configured to produce an indicator control signal to activate the indicator at predetermined times during use, and wherein the indicator produces an audio indication during use.

6. The system of claim 1, further comprising an indicator configured to provide an indication to the participant to apply a participant signal, wherein the indicator is coupled to the control system and positioned proximate to the activation point, and wherein the control system is further configured to produce an indicator control signal to activate the indicator at predetermined times during use, and wherein the indicator produces a tactile indication during use.

7. The system of claim 1, further comprising an indicator configured to provide an indication to the participant to apply a participant signal, wherein the indicator is coupled to the control system and positioned proximate to the activation point, and wherein the control system is further configured to produce an indicator control signal to activate the indicator at predetermined times during use, wherein the indicator comprises an image projected on a screen during use.

8. The system of claim 1, wherein the activation point comprises a pressure sensitive device, and wherein the participant signal comprises applying force to the activation point.

9. The system of claim 1, wherein the activation point comprises a movable activating device, and wherein the participant signal comprises moving the activating device.

10. The system of claim 1, wherein the activation point comprises a motion detector, and wherein the participant signal comprises creating movement within a detection area of the motion detector.

11. The system of claim 1, wherein the activation point comprises a sound detector, and wherein the participant signal comprises creating a sound.

12. The system of claim 1, wherein the activation point comprises a transducer for measuring a magnitude of the participant signal.

13. The system of claim 1, further comprising a plurality of additional activation points for detecting participant signals during use.

14. The system of claim 1, further comprising a plurality of additional activation points for detecting participant signals during use, and wherein the water system is configured to produce a plurality of water effects, and wherein the control system is further configured to produce different water system control signals in response to different activation signals received from different activation points, wherein the water system is configured to produce different water effects in response to different water system control system signals.

15. The system of claim 1, wherein the control system is configured to produce water system control signals when an activation signal is not received for a predetermined amount of time.

16. The system of claim 1, further comprising a participant detection system coupled to the control system, wherein the participant detection system is configured to detect the presence of a participant proximate to the water system and generate a detection signal in response to the presence of a participant proximate to the water system, and wherein the control system is configured to produce water system control signals in response to a detection signal.

17. The system of claim 1, further comprising a participant detection system coupled to the control system, wherein the participant detection system is configured to detect the presence of a participant proximate to the water system and generate a detection signal in response to the presence of a participant proximate to the water system, and wherein the control system is configured to produce water system control signals in response to a detection signal, and wherein the control system is further configured to stop generating water system control signals in the absence of a detection signal.

18. The system of claim 1, wherein the control system comprises a programmable logic controller.

19. The system of claim 1, wherein the control system is further configured to stop generating the water control signals in the absence of activation signals when the control system receives one or more participant signals.

20. A method of operating a water system configured to produce a water effect, comprising:

applying one or more participant signals to an activation point;

producing an activation signal in response to the applied participant signal;

sending the activation signal to a control system;

producing a water system control signal in the control system in response to the received activation signal;

sending the water system control signal from the control system to the water system, wherein the water system produces the water effect in response to the water system control signal;

producing a water system control signal in the control system in the absence of an activation signal;

sending the water system control signal produced in the absence of an activation signal from the control system to the water system to produce a water effect.

21. The method of claim 20, wherein the water system comprises a water effect generator, a conduit for carrying water to the water effect generator, and a valve disposed in the conduit, the valve configured to control the flow of water through the conduit, and further comprising operating the valve in response to the water system control signals generated by the control system.

22. The method of claim 20, wherein the activation point comprises a pressure sensitive device, and wherein the participant signal comprises applying force to the activation point.

23. The method of claim 20, wherein the activation point comprises a movable activating device, and wherein the participant signal comprises moving the activating device.

24. The method of claim 20, wherein the activation point comprises a motion detector, and wherein the participant signal comprises creating movement within a detection area of the motion detector.

25. The method of claim 20, wherein the activation point comprises a sound detector, and wherein the participant signal comprises creating a sound.

26. The method of claim 20, wherein the activation point comprises a transducer for measuring a magnitude of the participant signal.

27. The method of claim 20, wherein the water system further comprises a plurality of additional activation points for detecting participant signals during use.

28. The method of claim 20, wherein producing the water system control signal in the control system in the absence of an activation signal comprises producing the water system control signal when an activation signal is not received for a predetermined amount of time.

29. The method of claim 20, wherein the water system further comprises a participant detection system coupled to the control system, further comprising:

detecting the presence of a participant proximate to the water system with the participant detection system;

generating a detection signal in response to the presence of a participant proximate to the water system, and producing water system control signals in response to the detection signal.

30. The method of claim 20, wherein the water system further comprises a participant detection system coupled to the control system, further comprising:

detecting the presence of a participant proximate to the water system with the participant detection system;

generating a detection signal in response to the presence of a participant proximate to the water system, producing water system control signals in response to a detection signal; and inhibiting the generation of water system control signals in the absence of a detection signal.

31. The method of claim 20, wherein the control system comprises a programmable logic controller.

32. A system comprising:

a water system, the water system comprising:

a first hollow member comprising a closed end and an opposite end having an opening therein;

a second hollow member comprising first and second opposing open ends, wherein the second hollow member is of smaller diameter than the first hollow member, and wherein, during use, the second hollow member is disposed in the opening in the first hollow member to form an airtight seal within the opening, such that the second open end is inside the first hollow member;

a partition member with an opening therein, wherein, during use, the partition member is disposed inside the first hollow member and the second hollow member is disposed in the opening in the partition member, such that the partition member is slidable along at least of portion of the second hollow member, and further wherein the partition member substantially forms a partition from the exterior surface of the second hollow member to the interior surface of the first hollow member;

one or more fluid inlets configured to release fluid into the first hollow member during use;

one or more gas inlets configured to release a gas into the first hollow member during use, and wherein the partition member is disposed between a gas inlet and the closed end of the first hollow member during use; and a control mechanism in communication with a gas inlet, the control mechanism being configured to control a flow of gas to the gas inlet;

a control system coupled to the water system, wherein the control system is configured to generate one or more water system control signals to activate the control mechanism of the water system to produce the water effect; and an activation point coupled to the control system, wherein the activation point is configured to receive one or more participant signals and send one or more activation signals to the control system;

wherein the control system is configured to generate a water system control signal in response to at least one participant signal during use, and wherein the control system is further configured to generate one or more additional water system control signals in the absence of a participant signal.

33. The system of claim 32, wherein the partition member comprises one or more openings in addition to the opening that contains the second hollow member.

34. The system of claim 32, wherein the partition member has a substantially planar shape.

35. The system of claim 32, wherein the activation point comprises an electronic switch, a manual switch, a lever, a handle, a wheel, a pedal, a pressure pad, a button, or a trigger.

36. The system of claim 32, wherein the first hollow member comprises a sight for aiming the water system.

37. The system of claim 32, wherein the second hollow member is configured such that, during use, when the first open end of the second hollow member is pointed parallel to the ground, the second open end of the second hollow member is positioned lower than the first open end.

38. The system of claim 32, wherein the second hollow member is configured such that, during use, when the first open end of the second hollow member is pointed parallel to the ground, the second open end of the second hollow member is positioned lower than the first open end, and wherein the second hollow member comprises a first section connected at an angle to a second section.

39. The system of claim 32, wherein the second hollow member is configured such that, during use, when the first open end of the second hollow member is pointed parallel to the ground, the second open end of the second hollow member is positioned lower than the first open end, and wherein the second hollow member comprises a first section connected to a curved section.

40. The system of claim 32, further comprising one or more gas release valves configured to release gas from the first hollow member.

41. The system of claim 32, further comprising one or more gas release valves configured to release gas from the first hollow member, and wherein the control mechanism is configured to control said gas release valves in response to a water system control signal.

42. The system of claim 32, further comprising one or more gas release valves configured to release gas from the first hollow member, and wherein the control mechanism is configured to control the gas release valve in response to a water system control signal such that the gas release valve is open when the first hollow member is empty of fluid, and the gas release valve is closed when the fluid reaches a predetermined level in the first hollow member during use.

43. The system of claim 32, wherein the diameter of the second hollow member is about one-third the diameter of the first hollow member.

44. The system of claim 32, wherein the diameter of the second hollow member is from about one-fifth to about three-fifths the diameter of the first hollow member.

45. The system of claim 32, further comprising a support apparatus, wherein the support apparatus comprises a base and an upright member connecting the base to the first hollow member, wherein the first hollow member is configured to swivel from side to side with respect to the base during use.

46. The system of claim 32, further comprising a support apparatus, wherein the support apparatus comprises a base and an upright member connecting the base to the first hollow member, wherein the first hollow member is configured to swivel from side to side with respect to the base during use, and wherein the first hollow member is configured to swivel vertically with respect to the base during use.

47. The system of claim 32, further comprising a support apparatus, wherein the support apparatus comprises a base and an upright member connecting the base to the first hollow member, wherein the first hollow member is configured to swivel from side to side with respect to the base during use, and wherein the support apparatus comprises at least one semispherical ball and cup connector.

48. The system of claim 32, further comprising a support apparatus, wherein the support apparatus comprises a base and an upright member connecting the base to the first hollow member, wherein the first hollow member is configured to swivel from side to side with respect to the base during use, and wherein the support apparatus comprises a seat for an operator.

49. The system of claim 32, the activation point is a foot operated switch.

50. The system of claim 32, wherein the fluid comprises water.

51. The system of claim further comprising a support apparatus including a seat for an operator.

52. The system of claim 32, wherein the activation point comprises a pressure sensitive device, and further comprising applying force to the activation point.

53. The system of claim 32, wherein the fluid comprises water, and wherein the water system is configured to eject a projectile of water.

54. The system of claim 32, wherein the second hollow member further comprises a first section connected at an angle to a second section.

55. The system of claim 32, wherein the second hollow member further comprises a curved section.

56. The system of claim 32, wherein the water system further comprises one or more air release valves configured to release air from the first hollow member.

57. The system of claim 32, wherein the water system further comprises one or more air release valves configured to release air from the first hollow member, further comprising opening the air release valve when the first hollow member is empty of fluid, and further comprising closing the air release valve when the fluid reaches a predetermined level in the first hollow member.

58. The system of claim 32, wherein the water system further comprises a support apparatus, and wherein the support apparatus comprises a seat for an operator.

59. A method of operating a water system, wherein the water system comprises:

a first hollow member comprising a closed end and an opposite end having an opening therein;

a second hollow member comprising first and second opposing open ends, wherein the second hollow member is of smaller diameter than the first hollow member, and wherein, during use, the second hollow member is disposed in the opening in the first hollow member to form an airtight seal within the opening, such that the first open end is outside the first hollow member, or coplanar with an end of the first hollow member, and the second open end is inside the first hollow member;

a partition member with an opening therein, wherein, during use, the partition member is disposed inside the first hollow member and the second hollow member is disposed in the opening in the partition member, such that the partition member is slidable along at least of portion of the second hollow member, and further wherein the partition member substantially forms a partition from the exterior surface of the second hollow member to the interior surface of the first hollow member;

one or more fluid inlets connected to a fluid source and configured to release fluid into the first hollow member during use;

one or more gas inlets connected to a source of pressurized gas, and configured to release a gas into the first hollow member during use, and wherein the partition member is disposed between a gas inlet and the closed end of the first hollow member during use; and a control mechanism in communication with a gas inlet, the control mechanism being configured to control a flow of gas to the gas inlet;

a programmable control system coupled with the water amusement device, and configured to operate the control mechanism and the fluid inlet;

the method comprising:

applying one or more participant signals to an activation point;

producing an activation signal in response to the applied participant signal;

sending the activation signal to a control system;

producing a water system control signal in the control system in response to the received activation signal;

sending the water system control signal from the control system to the control mechanism, wherein the control mechanism allows gas to flow into the gas inlet in response to the water system control signal;

producing a water system control signal in the control system in the absence of an activation signal;

sending the water system control signal produced in the absence of an activation signal from the control system to the control mechanism to operate the control mechanism.

60. The method of claim 59, wherein the fluid source comprises a water source.

61. The method of claim 59, wherein the water system further comprises a support apparatus including a seat for an operator.

62. The method of claim 59, wherein the activation point comprises a pressure sensitive device, and further comprising applying force to the activation point.

63. The method of claim 59, wherein the fluid source comprises a water source and the device is configured to eject a projectile of water.

64. The method of claim 59, wherein the second hollow member comprises a first section connected at an angle to a second section.

65. The method of claim 59, wherein the second hollow member comprises a curved section.

66. The method of claim 59, wherein the water system further comprises one or more air release valves configured to release air from the first hollow member.

67. The method of claim 59, wherein the water system further comprises one or more air release valves configured to release air from the first hollow member, further comprising opening the air release valve when the first hollow member is empty of fluid, and further comprising closing the air release valve the fluid reaches a predetermined level in the first hollow member.

68. The method of claim 59, wherein the water system further comprises a support apparatus, and wherein the support apparatus comprises a base and an upright member connecting the base to the first hollow member, wherein the first hollow member is configured to swivel from side to side with respect to the base during use.

69. The method of claim 59, wherein the activation point comprises a foot operated switch.

70. The method of claim 59, wherein the partition member comprises one or more openings in addition to the opening that contains the second hollow member.

71. The method of claim 59, wherein the partition member has a substantially planar shape.

72. The method of claim 59, wherein the activation point comprises an electronic switch, a manual switch, a lever, a handle, a wheel, a pedal, a pressure pad, a button, or a trigger.

73. The method of claim 59, wherein the first hollow member comprises a sight for aiming the water system.

74. The method of claim 59, wherein the second hollow member is configured such that, during use, when the first open end of the second hollow member is pointed parallel to the ground, the second open end of the second hollow member is positioned lower than the first open end.

75. The method of claim 59, wherein the second hollow member is configured such that, during use, when the first open end of the second hollow member is pointed parallel to the ground, the second open end of the second hollow member is positioned lower than the first open end, and wherein the second hollow member comprises a first section connected at an angle to a second section.

76. The method of claim 59, wherein the second hollow member is configured such that, during use, when the first open end of the second hollow member is pointed parallel to the ground, the second open end of the second hollow member is positioned lower than the first open end, and wherein the second hollow member comprises a first section connected to a curved section.

77. The method of claim 59, further comprising one or more gas release valves configured to release gas from the first hollow member.

78. The method of claim 59, further comprising one or more gas release valves configured to release gas from the first hollow member, and wherein the control mechanism is configured to control said gas release valves in response to a water system control signal.

79. The method of claim 59, further comprising one or more gas release valves configured to release gas from the first hollow member, and wherein the control mechanism is configured to control the gas release valve in response to a water system control signal such that the gas release valve is open when the first hollow member is empty of fluid, and the gas release valve is closed when the fluid reaches a predetermined level in the first hollow member during use.

80. The method of claim 59, wherein a diameter of the second hollow member is about one-third a diameter of the first hollow member.

81. The method of claim 59, wherein a diameter of the second hollow member is from about one-fifth to about three-fifths a diameter of the first hollow member.

82. The method of claim 59, further comprising a support apparatus, wherein the support apparatus comprises a base and an upright member connecting the base to the first hollow member, wherein the first hollow member is configured to swivel from side to side with respect to the base during use, and wherein the first hollow member is configured to swivel vertically with respect to the base during use.

83. The method of claim 59, further comprising a support apparatus, wherein the support apparatus comprises a base and an upright member connecting the base to the first hollow member, wherein the first hollow member is configured to swivel from side to side with respect to the base during use, and wherein the support apparatus comprises at least one semispherical ball and cup connector.

84. The method of claim 59, further comprising a support apparatus, wherein the support apparatus comprises a base and an upright member connecting the base to the first hollow member, wherein the first hollow member is configured to swivel from side to side with respect to the base during use, and wherein the support apparatus comprises a seat for an operator.

85. A method of operating a water system configured to produce a water effect, comprising:

applying one or more participant signals to an activation point;

producing an activation signal in response to the applied participant signal;

sending the activation signal to a control system;

producing a water system control signal in the control system in response to the received activation signal;

sending the water system control signal from the control system to the water system, wherein the water system produces the water effect in response to the water system control signal;

producing an indicator control signal from the control system;

sending the indicator control signal to an indicator, wherein the indicator is coupled to the control system and positioned proximate to the activation point, sending an indication to a participant to apply a participant signal with the indicator in response to the received indictor control signal producing a water system control signal in the control system in the absence of an activation signal;

sending the water system control signal produced in the absence of an activation signal from the control system to the water system to produce a water effect.

86. The method of claim 85, further comprising:

producing an indicator control signal from the control system;

sending the indicator control signal to an indicator, wherein the indicator is coupled to the control system and positioned proximate to the activation point, sending an indication to a participant to apply a participant signal with the indicator in response to the received indictor control signal, and wherein the indication is a visual indication.

87. The method of claim 85, further comprising:

producing an indicator control signal from the control system;

sending the indicator control signal to an indicator, wherein the indicator is coupled to the control system and positioned proximate to the activation point, sending an indication to a participant to apply a participant signal with the indicator in response to the received indictor control signal, and wherein the indication is an audio indication.

88. The method of claim 85, further comprising:

producing an indicator control signal from the control system;

sending the indicator control signal to an indicator, wherein the indicator is coupled to the control system and positioned proximate to the activation point, sending an indication to a participant to apply a participant signal with the indicator in response to the received indictor control signal, and wherein the indication is a tactile indication.

89. The method of claim 85, further comprising:

producing an indicator control signal from the control system;

sending the indicator control signal to an indicator, wherein the indicator is coupled to the control system and positioned proximate to the activation point, sending an indication to a participant to apply a participant signal with the indicator in response to the received indictor control signal, and wherein the indication comprises an image projected on a screen.

90. A method of operating a water system configured to produce a water effect, comprising:

applying one or more participant signals to an activation point;

producing an activation signal in response to the applied participant signal;

sending the activation signal to a control system;

producing a water system control signal in the control system in response to the received activation signal;

sending the water system control signal from the control system to the water system, wherein the water system comprises:

a plurality of activation points for detecting participant signals during use;

wherein the water system is configured to produce a plurality of water effects, and wherein the water system produces the water effect in response to the water system control signal;

producing different water system control signals in response to different activation signals received from different activation points;

sending the different water control system signals to the water system, wherein the water system is configured to produce different water effects in response to different water system control system signals;

producing a water system control signal in the control system in the absence of an activation signal;

sending the water system control signal produced in the absence of an activation signal from the control system to the water system to produce a water effect.

91. The method of claim 90, wherein the water system further comprises a water effect generator, a conduit for carrying water to the water effect generator, and a valve disposed in the conduit, the valve configured to control the flow of water through the conduit, and further comprising operating the valve in system control signals generated by the control system.

92. The method of claim 90, wherein the water system further comprises a participant detection system coupled to the control system, further comprising:

detecting the presence of a participant proximate to the water system with the participant detection system;

generating a detection signal in response to the presence of a participant proximate to the water system, producing water system control signals in response to a detection signal; and inhibiting the generator of water system control signals in the absence of a detection signal.

* * * * *

UNITED STATES PATENT AND TRADEMARK OFFICE

CERTIFICATE OF CORRECTION

PATENT NO. : 6,702,687 B1
DATED : March 9, 2004
INVENTOR(S) : Jeffery W. Henry

It is certified that error appears in the above-identified patent and that said Letters Patent is hereby corrected as shown below:

Column 31,
Line 23, please delete "of claim further" and substitute therefor -- of claim 32 further --.

Signed and Sealed this

Twenty-fifth Day of May, 2004

JON W. DUDAS
*Acting Director of the United States Patent and Trademark Office*